US007551062B2

(12) United States Patent
Croft, III et al.

(10) Patent No.: US 7,551,062 B2
(45) Date of Patent: Jun. 23, 2009

(54) DIRECTIONAL ACOUSTIC DEVICE

(75) Inventors: James J. Croft, III, San Diego, CA (US); Wensen Liu, San Diego, CA (US); Clifton Wynn Thompson, San Diego, CA (US)

(73) Assignee: American Technology Corporation, San Diego, CA (US)

( * ) Notice: Subject to any disclaimer, the term of this patent is extended or adjusted under 35 U.S.C. 154(b) by 0 days.

(21) Appl. No.: 11/901,270

(22) Filed: Sep. 14, 2007

(65) Prior Publication Data

US 2008/0129470 A1 Jun. 5, 2008

Related U.S. Application Data

(63) Continuation of application No. PCT/US2006/009358, filed on Mar. 14, 2006.

(60) Provisional application No. 60/661,812, filed on Mar. 14, 2005, provisional application No. 60/672,608, filed on Apr. 19, 2005, provisional application No. 60/710,425, filed on Aug. 22, 2005, provisional application No. 60/714,646, filed on Sep. 7, 2005.

(51) Int. Cl.
*G08B 3/10* (2006.01)

(52) U.S. Cl. ..... 340/384.7; 340/384.73; 340/384.1; 367/93; 367/94

(58) Field of Classification Search ..... 340/384.7, 340/384.73, 384.1; 367/93, 94
See application file for complete search history.

(56) References Cited

U.S. PATENT DOCUMENTS

| | | | | |
|---|---|---|---|---|
| 3,160,225 | A | 12/1964 | Sechrist | |
| 3,722,616 | A | 3/1973 | Beavers | |
| 4,348,549 | A | 9/1982 | Berlant | |
| 4,437,541 | A | 3/1984 | Cross | |
| 4,496,021 | A | 1/1985 | Berlant | |
| 5,579,399 | A | 11/1996 | Lucas | |
| 6,870,941 | B2 | 3/2005 | Marnie | |
| 6,905,001 | B1 | 6/2005 | Runciman | |
| 2008/0063224 | A1 * | 3/2008 | De Klerk | 381/304 |

FOREIGN PATENT DOCUMENTS

| | | |
|---|---|---|
| EP | 1137318 | 9/2001 |
| WO | WO 84 01681 | 4/1984 |
| WO | WO 0079833 | 12/2000 |
| WO | WO 2004 002190 | 12/2003 |

* cited by examiner

*Primary Examiner*—Toan N Pham
*Assistant Examiner*—Travis R Hunnings
(74) *Attorney, Agent, or Firm*—Thorpe North & Western LLP

(57) ABSTRACT

A directional acoustic device configured for producing a directional output along an acoustic axis, including at least one transducer configured to create at least two wave trains which are directed along differing pathways by at least one wave guide, and so disposed that in directions more than ninety degrees off the acoustic axis the SPL of the output is greatly diminished by cancellation effects between the wave trains; improvement over previous gradient and quarter-wave pipe directional systems being enabled.

46 Claims, 34 Drawing Sheets

Frequency = 1.400kHz
dB/div = 5
Center = 59.7dBs
Outer = 99.7dBs

Frequency = 1.013kHz
dB/div = 5
Center = 24.24dBs
Outer = 52.24dBs

DIRECTIONAL ACOUSTIC DEVICE

PRIORITY CLAIM

This is a continuation of PCT Application PCT/US06/009358 filed on Mar. 14, 2006, which claims priority to U.S. Provisional Patent Application Ser. No. 60/661,812 filed Mar. 14, 2005, and to U.S. Provisional Patent Application Ser. No. 60/672,608 filed Apr. 19, 2005, and to U.S. Provisional Patent Application Ser. No. 60/710,425 filed Aug. 22, 2005, and to U.S. Provisional Patent Application Ser. No. 60/714,646 filed Sep. 7, 2005, all of which are hereby incorporated herein by reference in their entirety.

BACKGROUND

The area of technical endeavor concerned is acoustics, and more particularly the area of directed acoustics wherein sound is controlled as to level at locations polar-plottable as distances and angles relative to a sound source and a primary acoustic axis.

It is often desirable to direct sound, so that it will be loud when perceived at locations near an acoustic axis along a direction of propagation along the axis, and attenuated at other locations. As one example of many that could be cited, in public address systems it is often desirable to project sound outward from a stage or podium, but not to overwhelm persons located there, yet have the projected sound be loud enough to be heard in a back portion of an audience (which may be quite extensive and some of which may be located far from the stage). There are other situations where directed sound would be desirable, some of which may not have been universally recognized by practitioners in the art of acoustics. As an example of this other category, it has been observed by some that back-up warning devices (sometimes called back-up beepers, because of the repeating single tone on-off nature of the output of such devices almost universally adopted) are needed but very annoying to the operators of vehicles on which they are installed. Also the output from back-up beepers can be undesirable at locations outside the area into which the vehicle is backing, for example trucks backing into loading docks at night have been known to wake persons sleeping in homes a considerable distance from the loading dock and not in line with the direction of the backing.

Moreover, numerous alarms, warning signals, and the like, are intended for persons in a specific area, and it would be desirable to direct the sound emitted to that area strongly, and have the sound projected in other directions be attenuated. Examples of this situation include but are not limited to train, truck and boat warning horns, whistles and the like, emergency vehicle sirens and the like. With respect to these it can be desirable to have an option to project an acoustic warning into an area along an axis of travel of the vehicle or craft, but to not project it rearward; and thus not so loudly disturb those behind. Those behind need not hear a loud warning, because with respect to those persons the warning is not very pertinent, as the hazard is moving away from them.

Door closing hazard warning tones and alarms, systems operators' warnings and alarms, crosswalk audio annunciator tones, and the like, directed to specific persons in specific areas are additional examples. Likewise fog horns (which need not disturb those inland) and other proximity hazard warning tones can be attenuated in directions not relevant to the purpose of the warning, resulting in less noise disruption overall.

Moreover, directivity with a narrow band acoustic signal and directivity with a wide band acoustic signal can be quite different problems. While many hailing and warning acoustic signals can be advantageously directed, these are typically narrow band signals or at least typically repeat within a defined frequency range. Returning to the auditorium venue or like example given above, wideband signals such as human voice or such as music program material, which are difficult to reproduce directionally, would be advantageously directionally reproduced if there were more cost-effective ways to do that.

SUMMARY

In one example embodiment the invention can be embodied in a directional acoustic device configured for directing an acoustic output along an acoustic axis, including: (a) at least one transducer configured for creating at least two wave trains which can be made to have a differing phase with respect to each other and which follow paths different in lengths; (b) at least one wave guide which is configured to define at least a part of said paths and to create a difference in length of said paths; and, (c) the wave trains destructively interfering in directions more than ninety degrees off the acoustic axis, the output being useful in directions close to the acoustic axis and usefully reduced in directions more than ninety degrees off the acoustic axis.

BRIEF DESCRIPTION OF THE DRAWING FIGURES

The invention is disclosed herein, and further features and advantages can be appreciated with reference to the examples hereinafter described and which are illustrated by the drawing figures, wherein.

Figure 27:
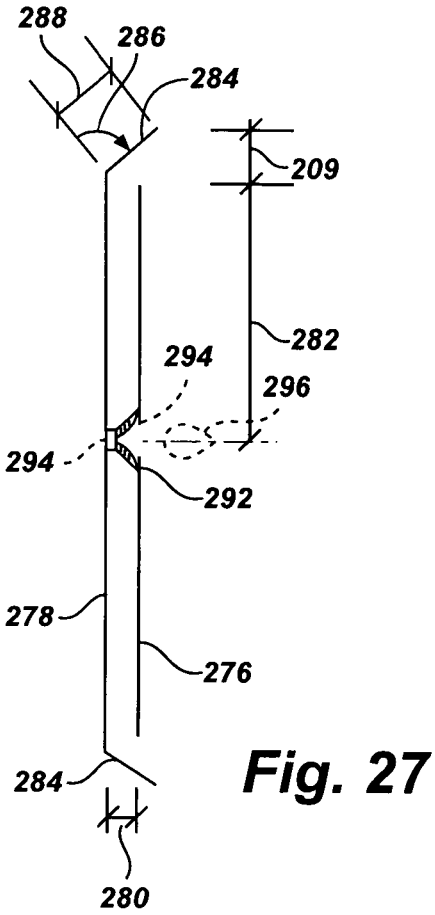
FIG. 27 is a schematical cross section view of another example embodiment, possible additional structural features being shown in outline.
Figure 28:
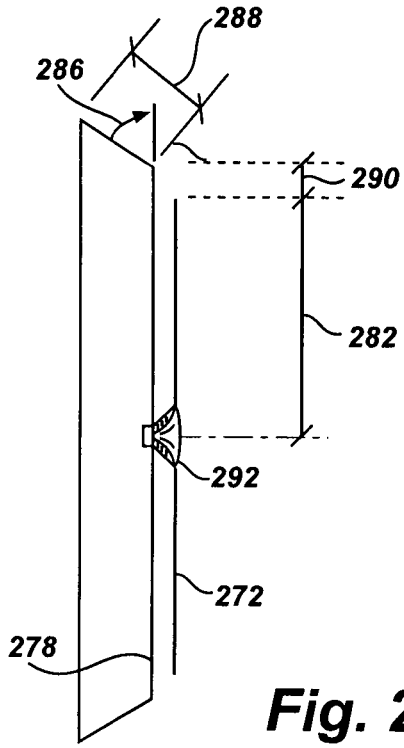
FIG. 28 is a schematical cross section view of another example embodiment.
Figure 34:
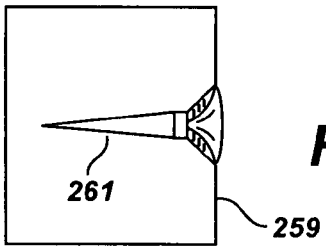
FIG. 34 is a schematical cross section view of another example embodiment.
Figure 34A:
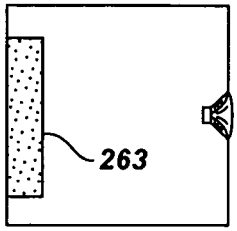
Figure 35:
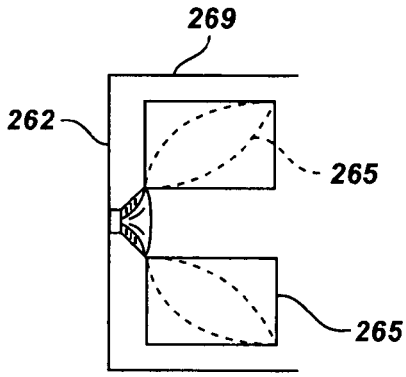
Figure 36:
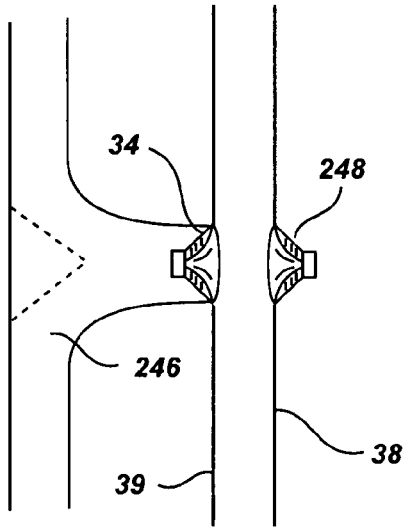
Figure 37:
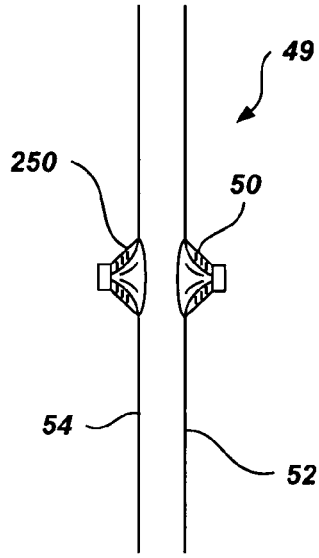
Figure 38:
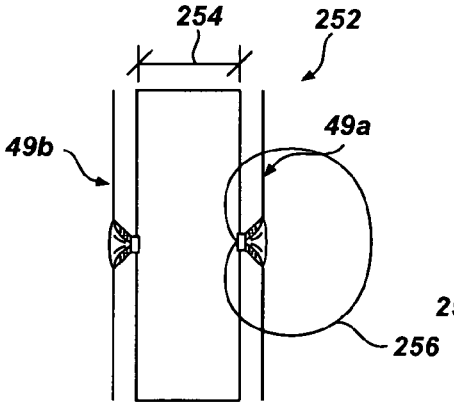
Figure 39:
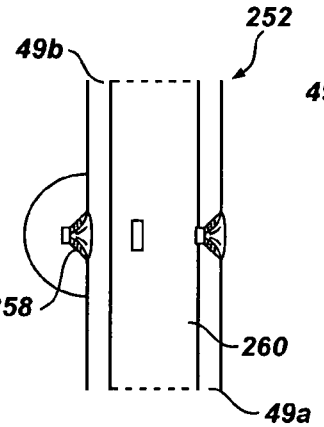
Figure 40:
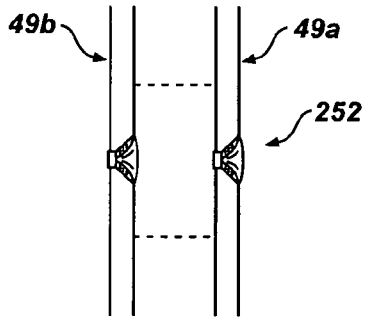
Figure 41:
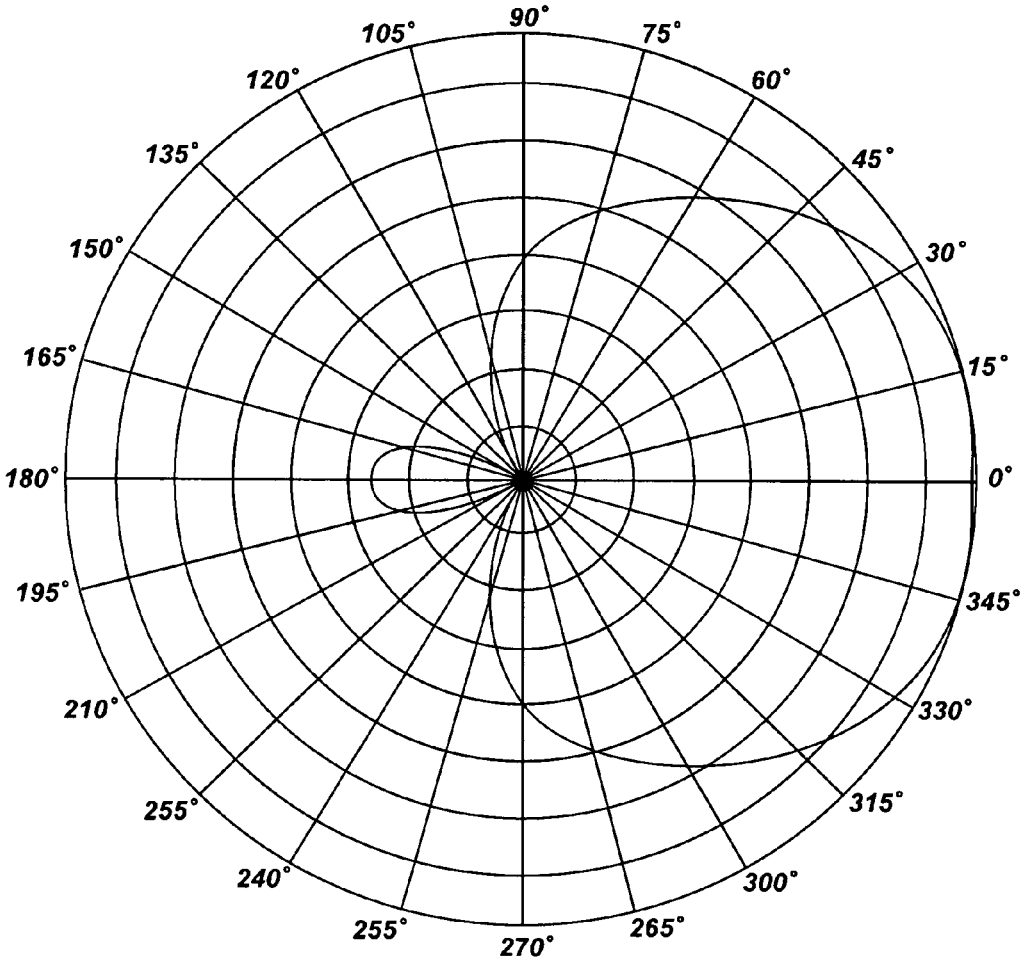
Figure 42:
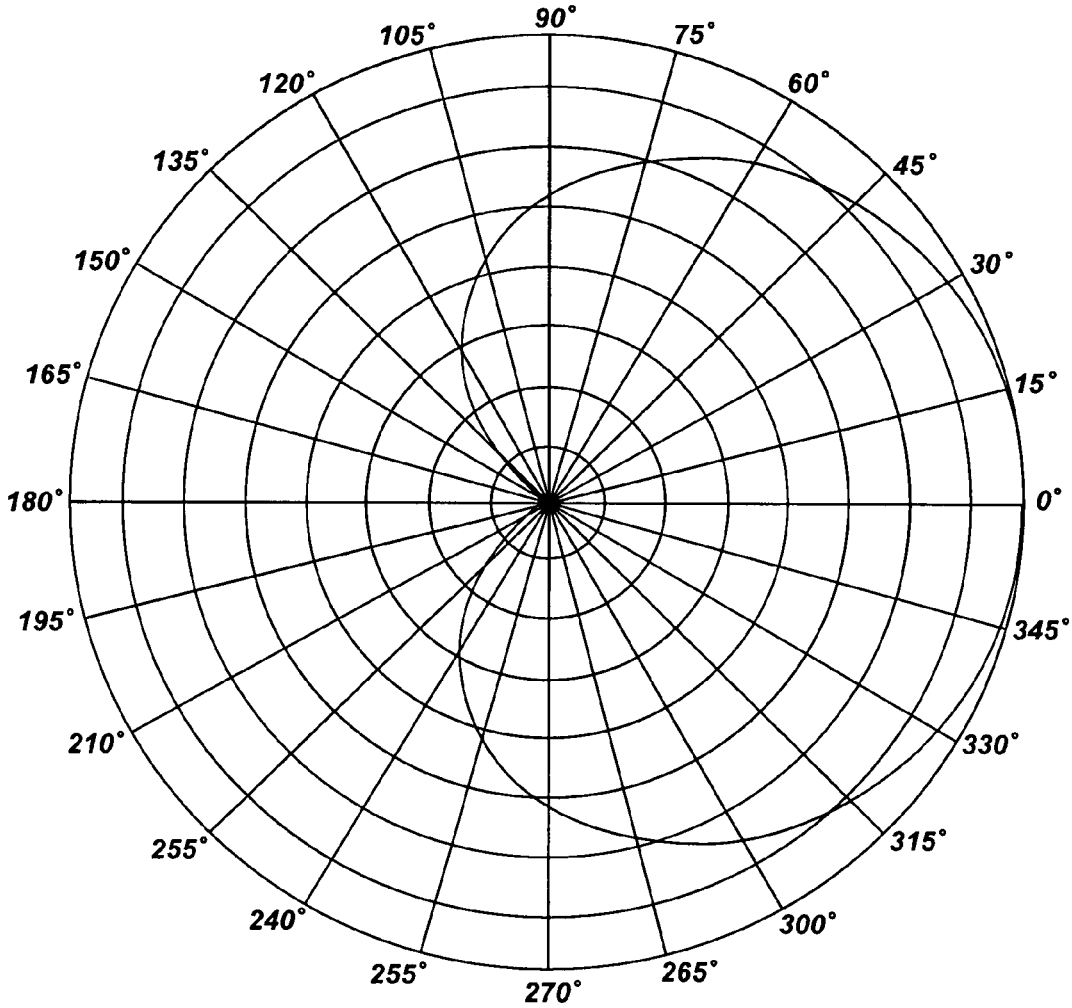
Figure 43:
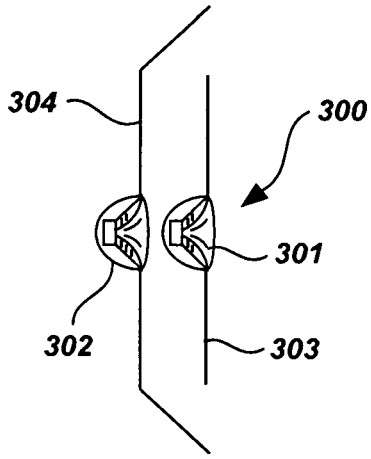
Figure 44:
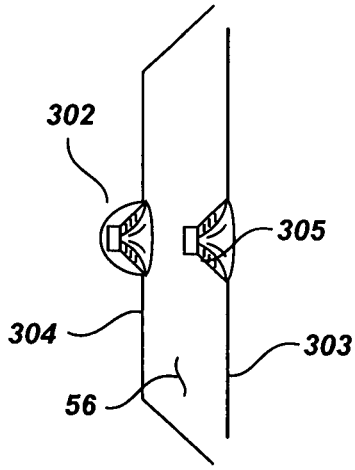
Figure 45:
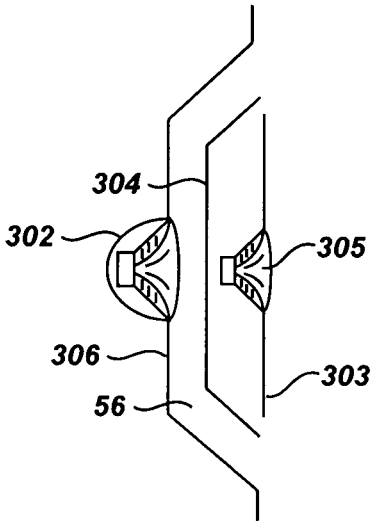
Figure 46:
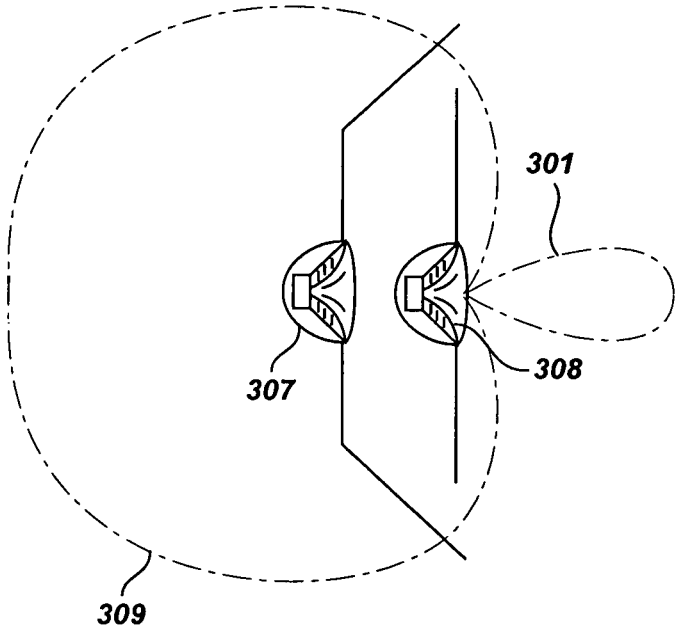
Figure 47:
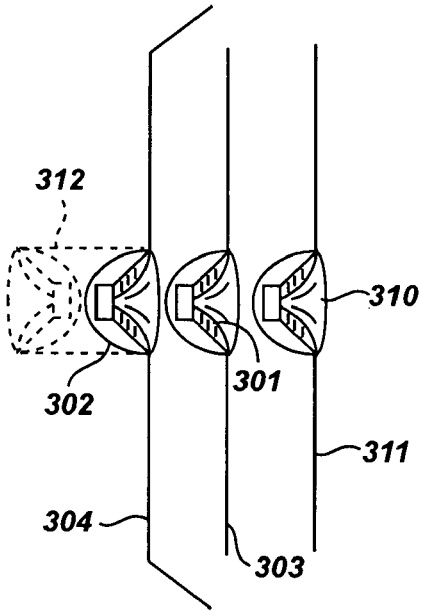
Figure 49:
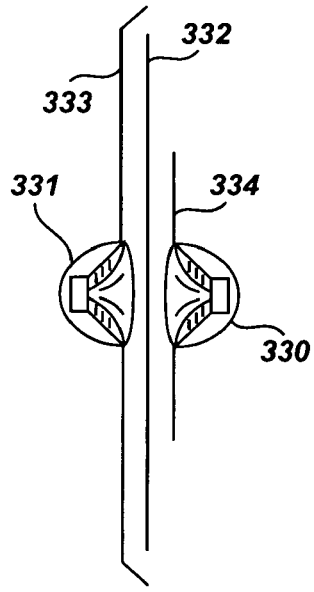
Figure 48A:
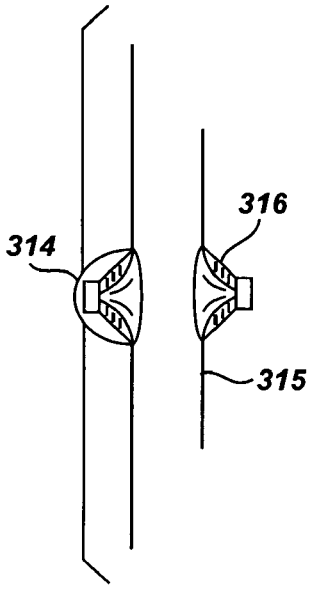
Figure 48B:
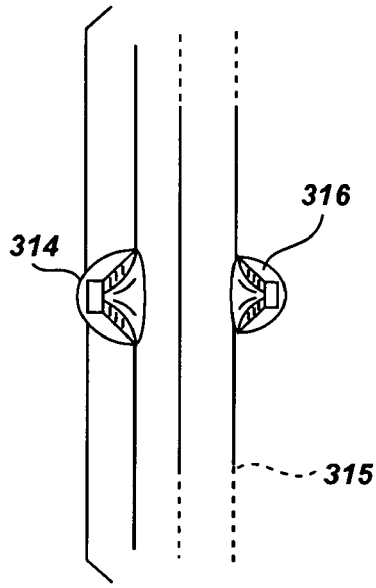
Figure 50:
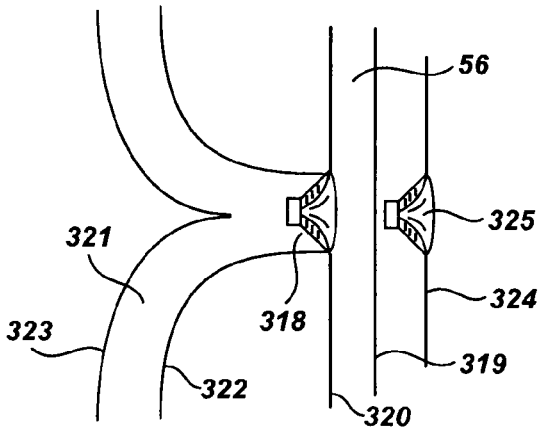
Figure 51:
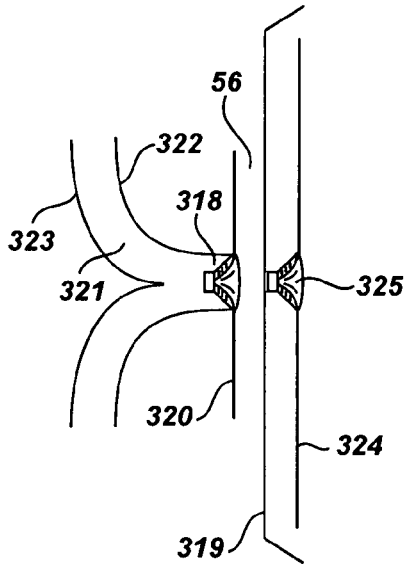
Figure 52:
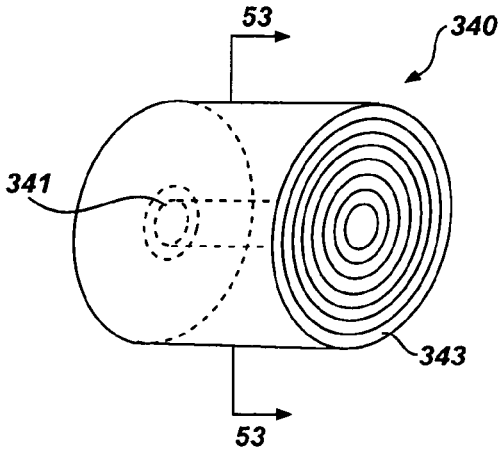
Figure 53:
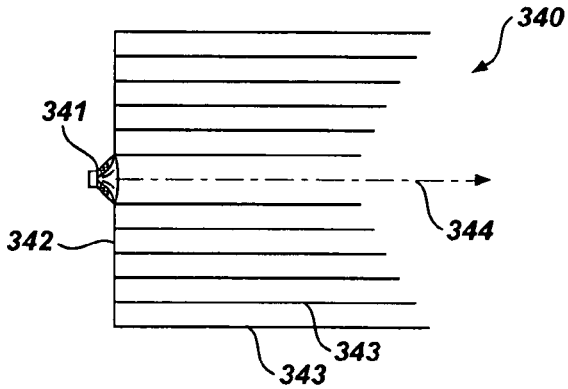
Figure 54:
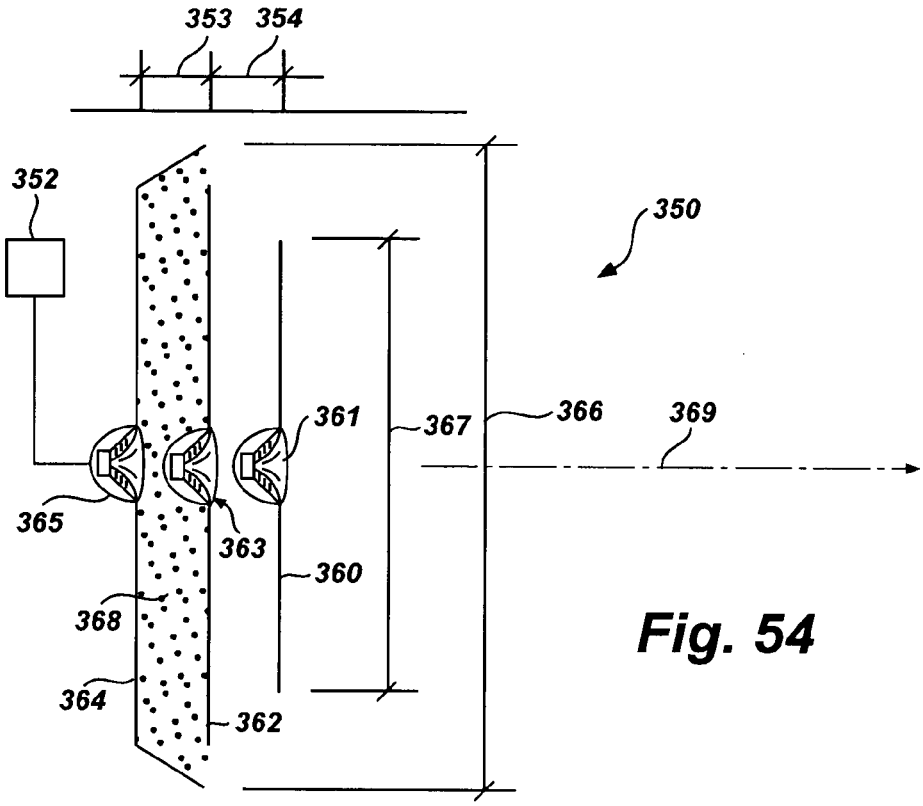
Figure 55:
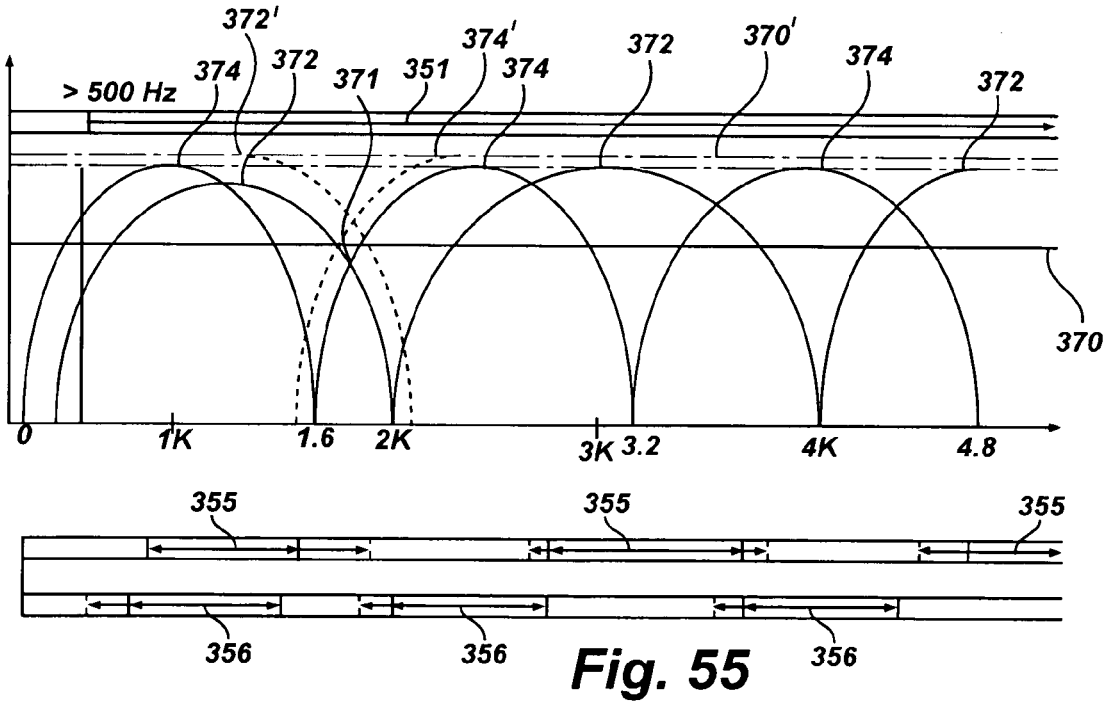
Figure 56:
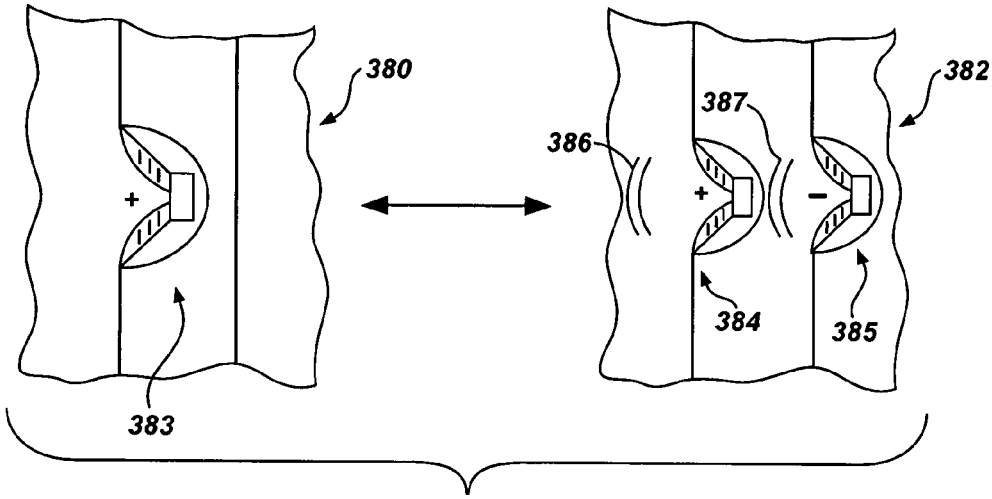
Figure 57:
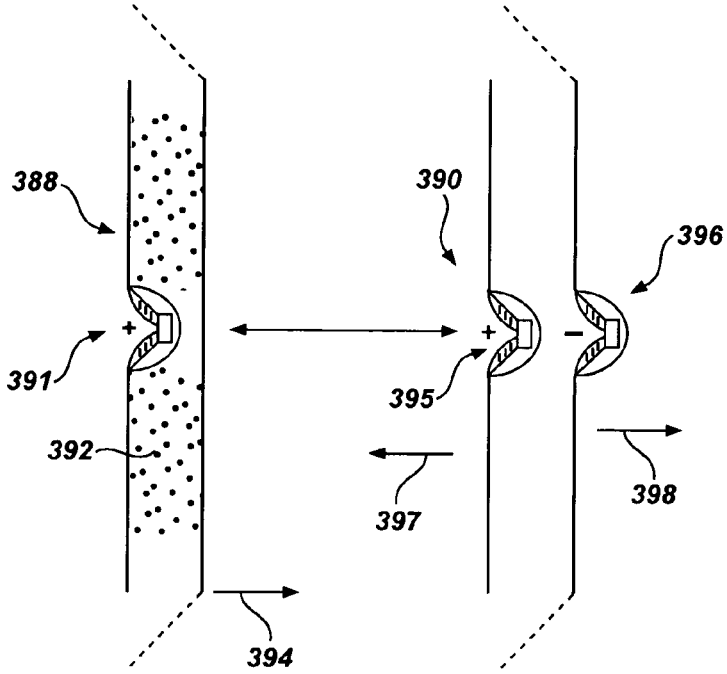
Figure 58:
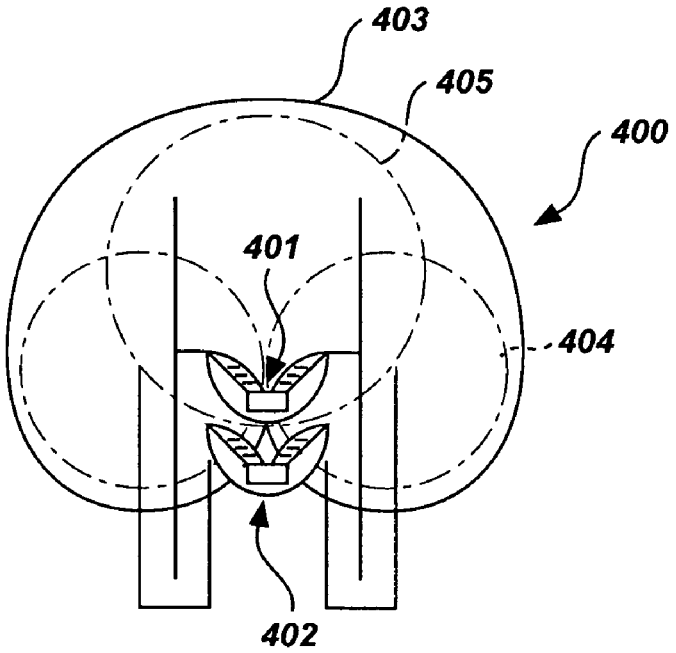
Figure 59:
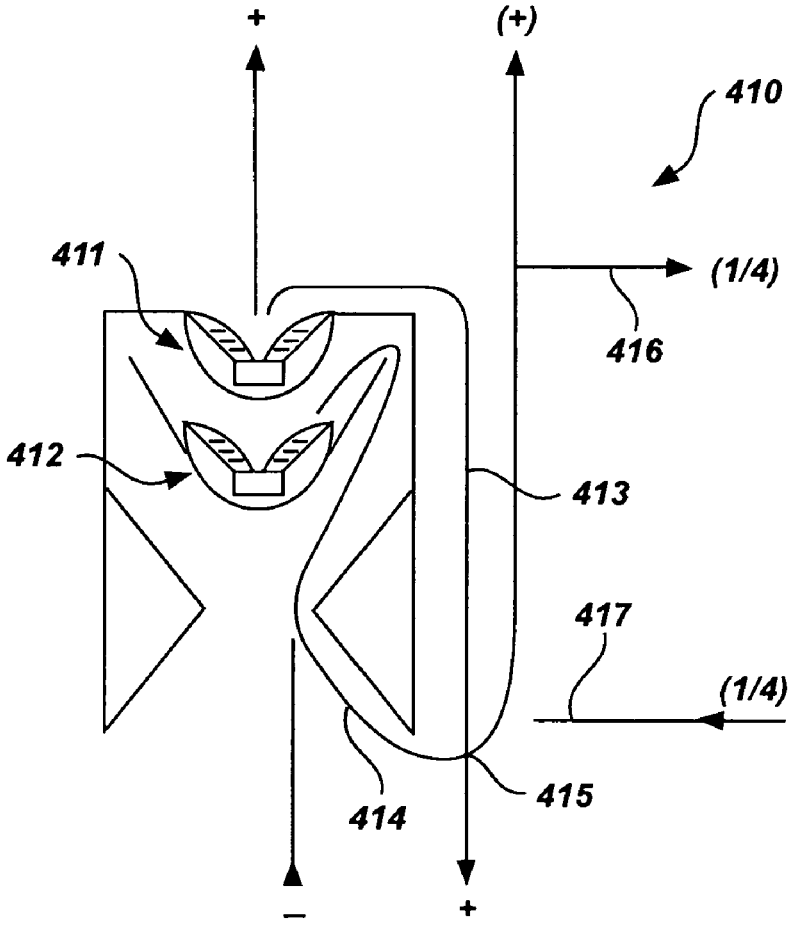
Figure 60:
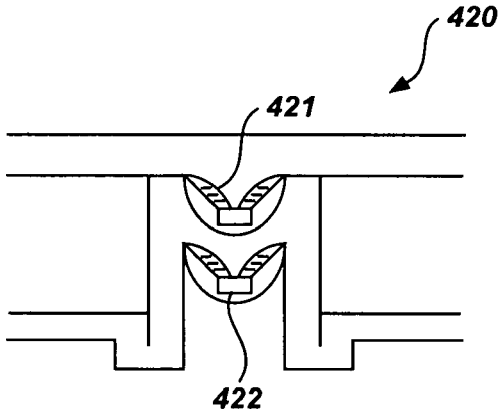
Figure 61:
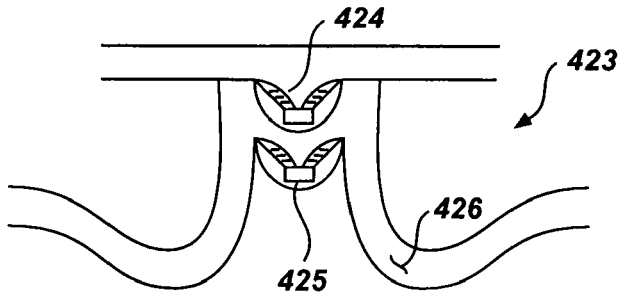
Figure 62:
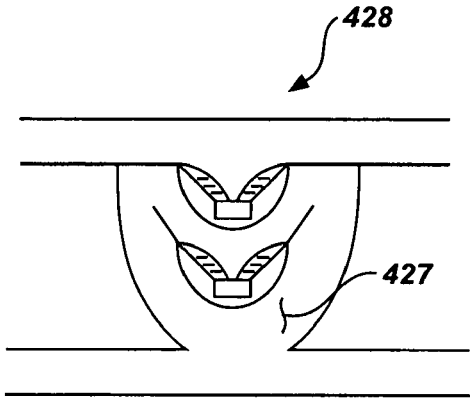
Figure 63:
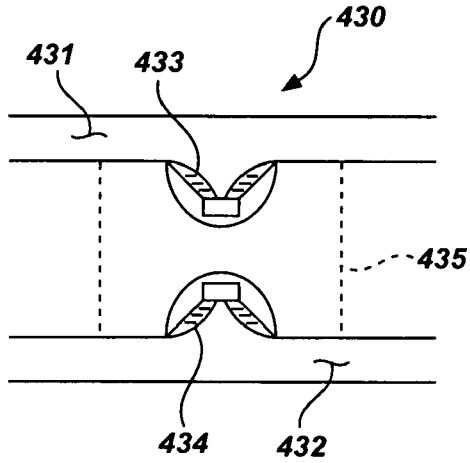
Figure 64:
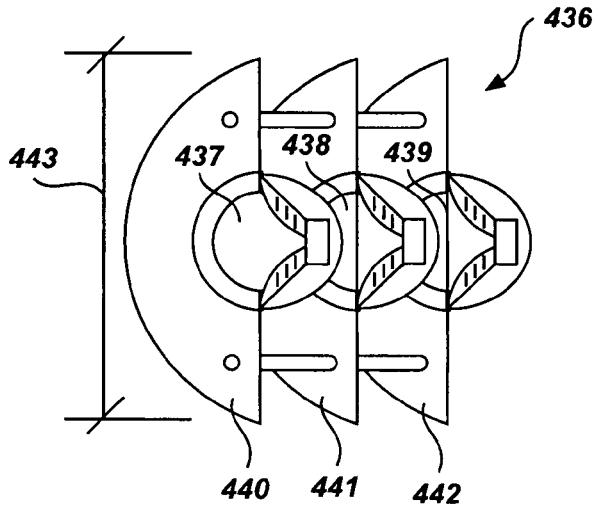
Figures 65A, 65B, 65C:
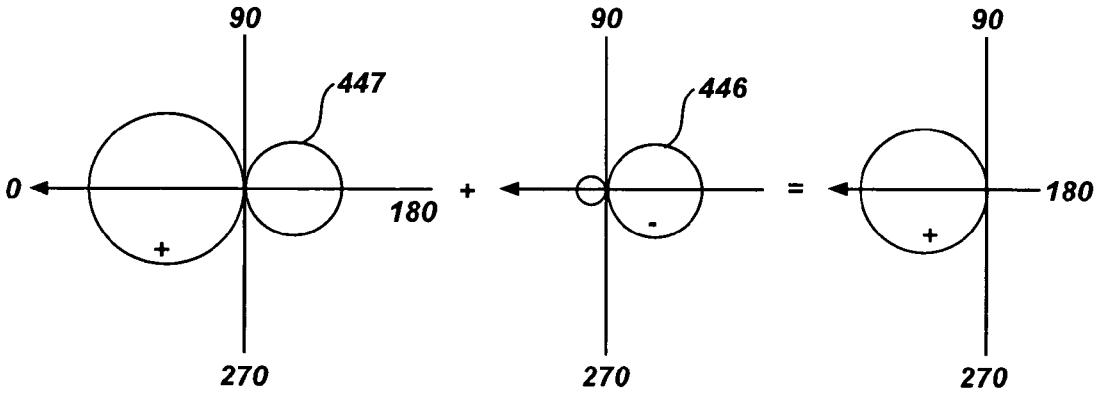
Figure 66:
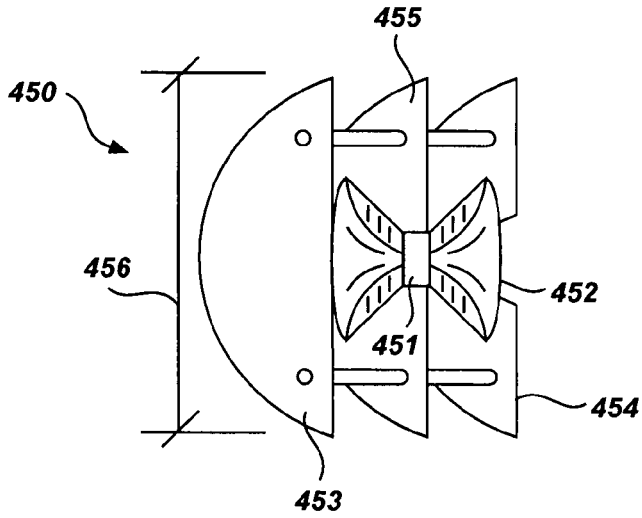
Figures 67A, 67B, 67C:
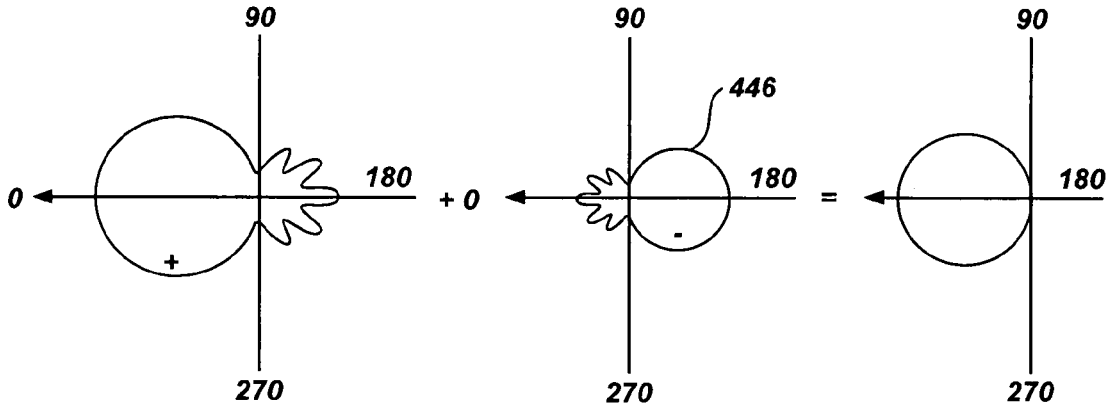
Figure 68:
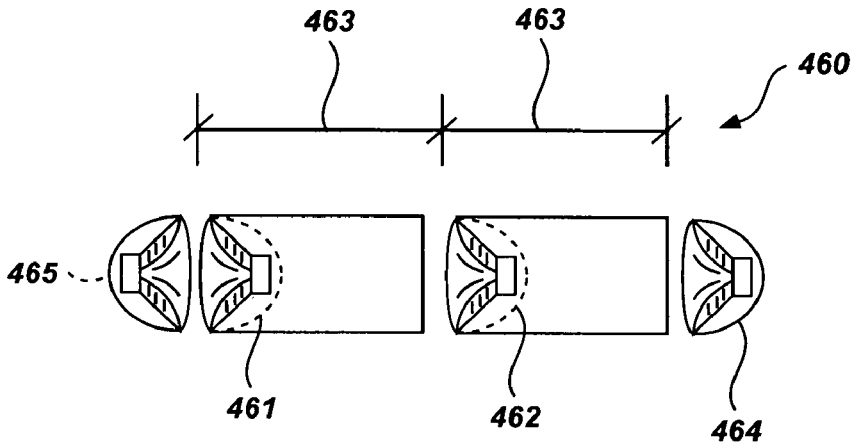
Figures 69A, 69B, 69C:
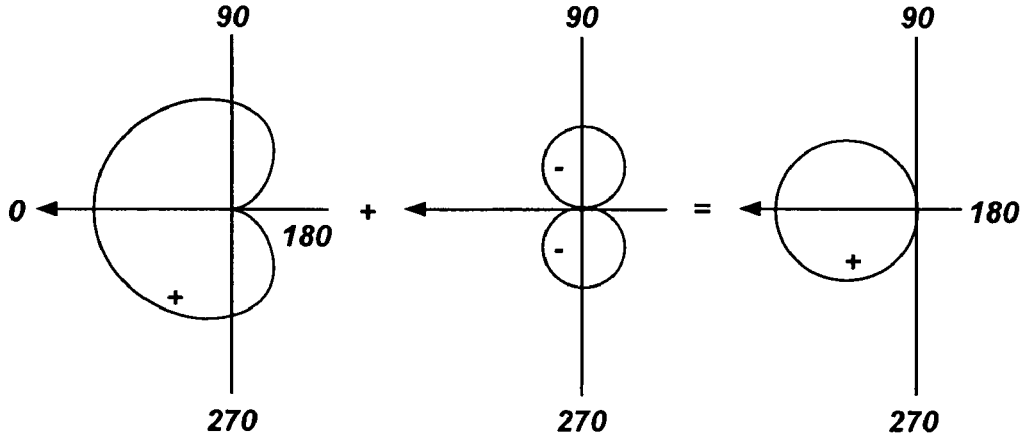
Figure 70:
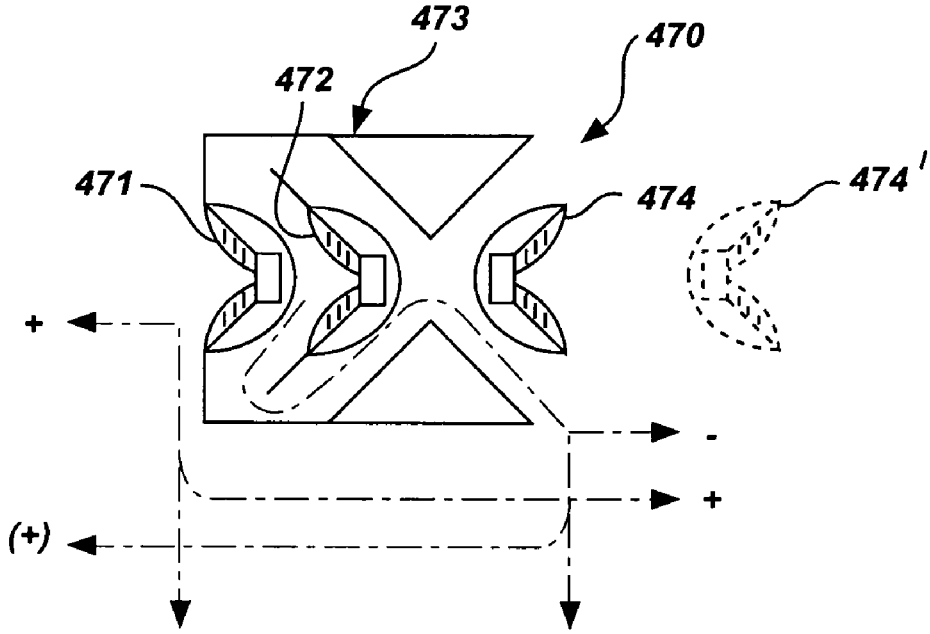
Figure 71:
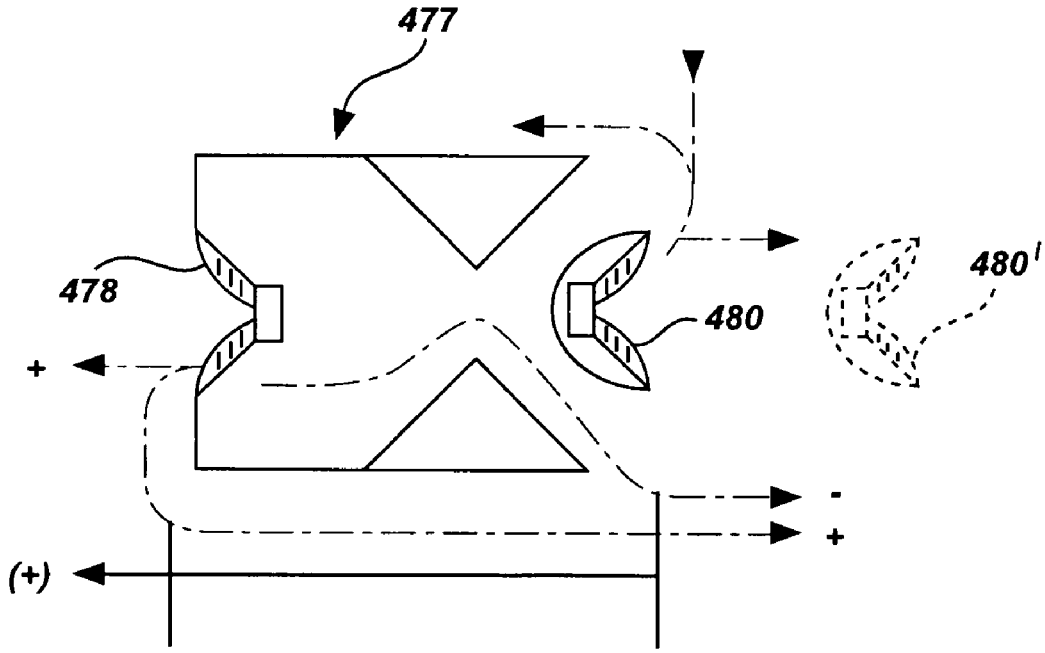
Figure 72:
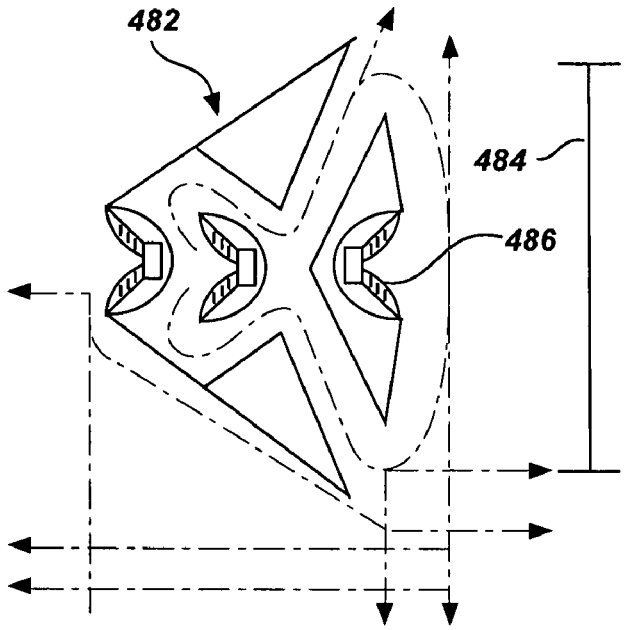
Figures 73A, 73B, 73C:
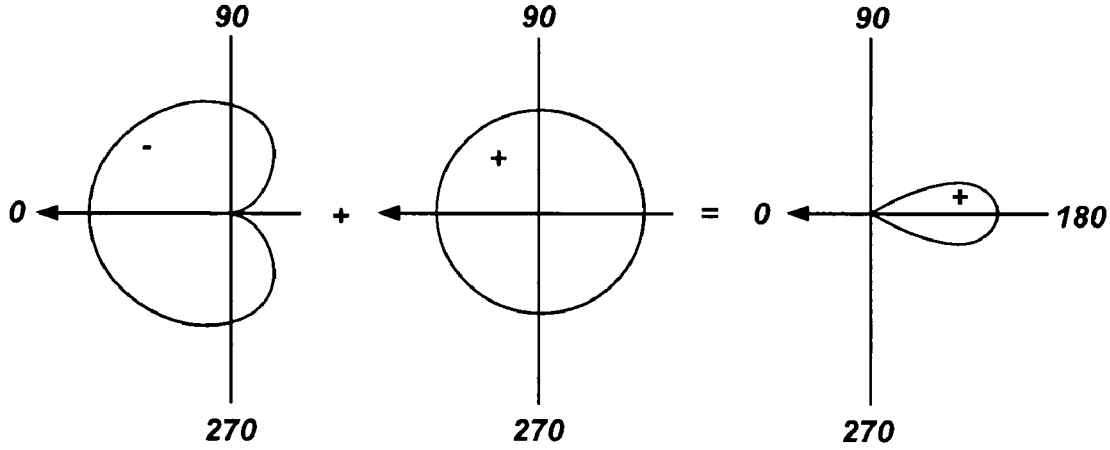
Figure 74:
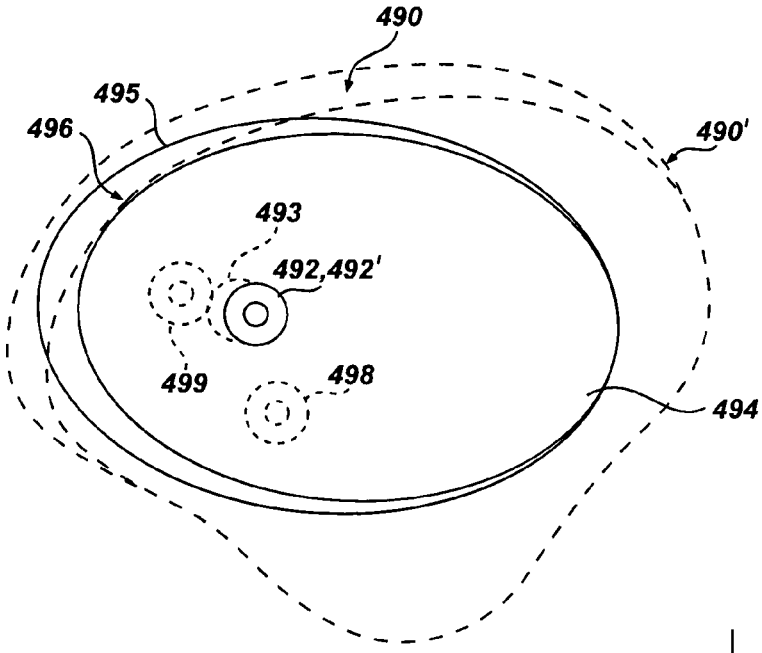
Figure 75:
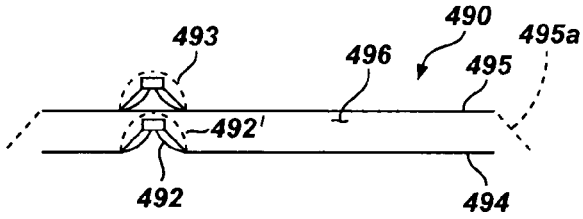
Figure 76:
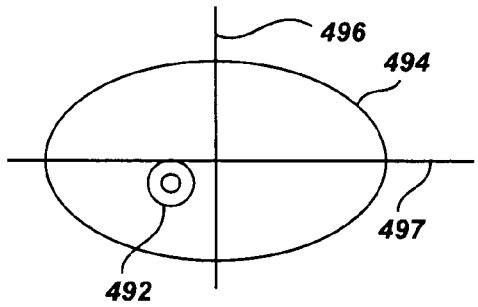
Figure 78:
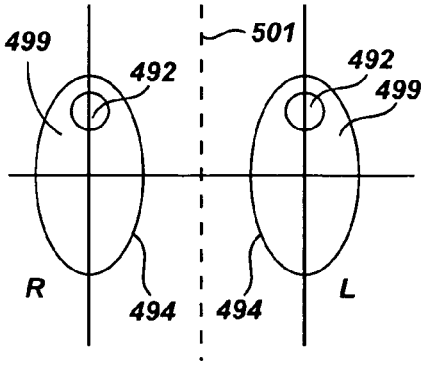
Figure 77:
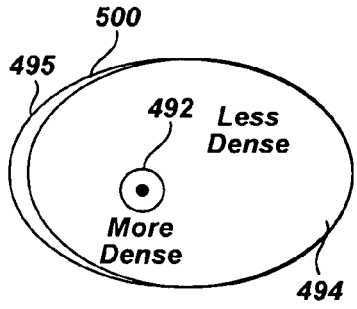
Figure 79:
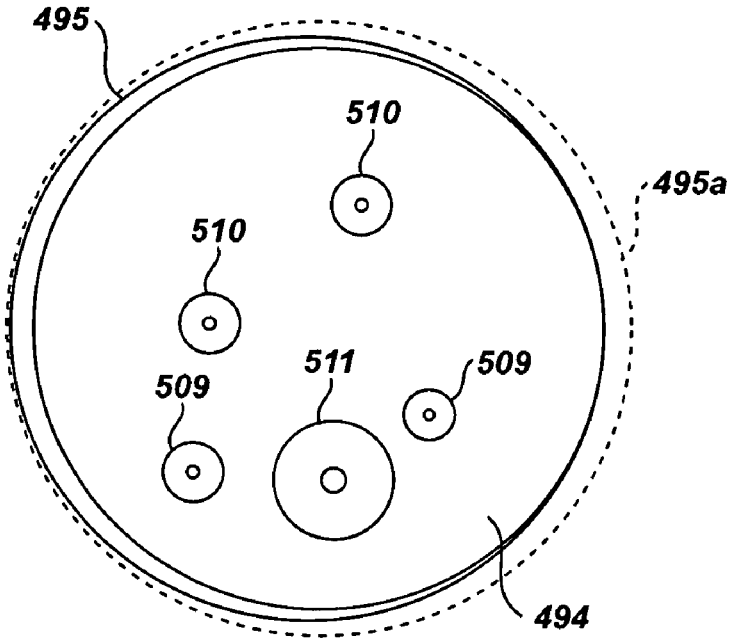
Figure 80:
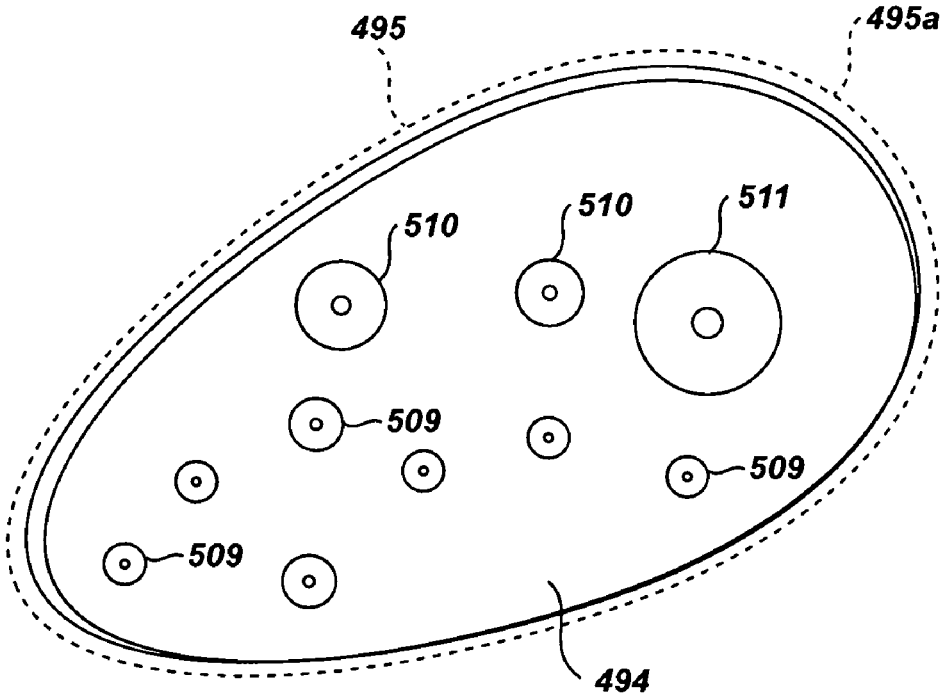
Figure 81:
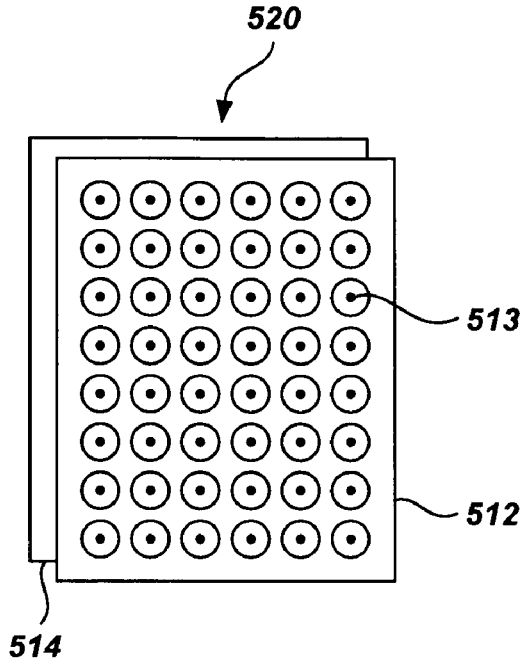
Figure 84:
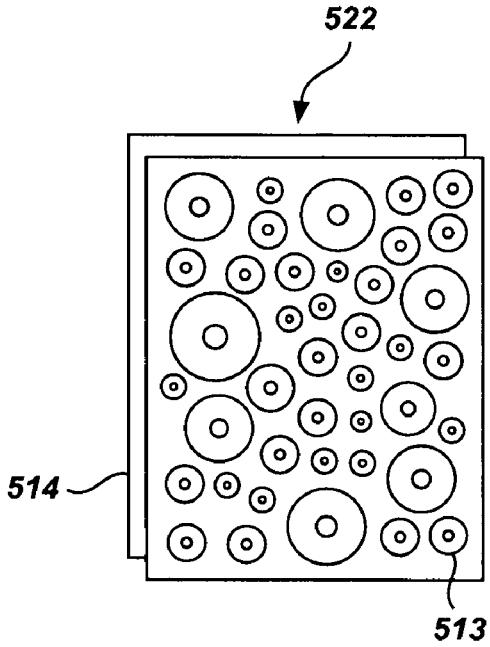
Figure 82:
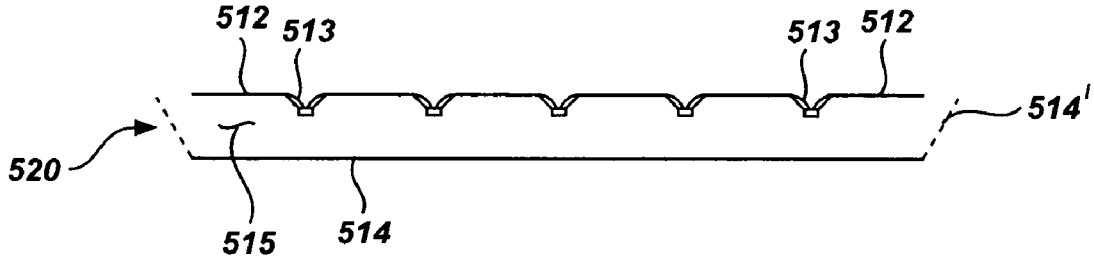
Figure 83:
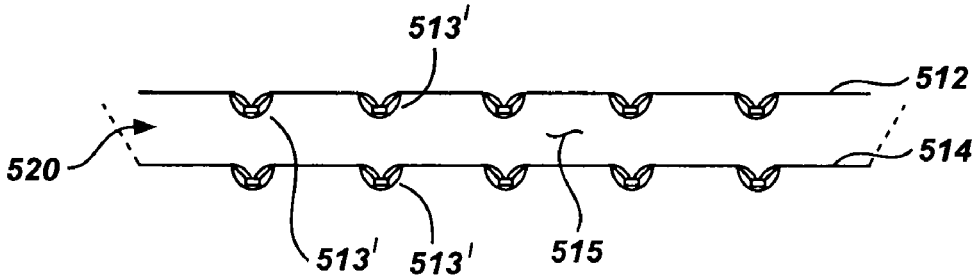
Figure 85:
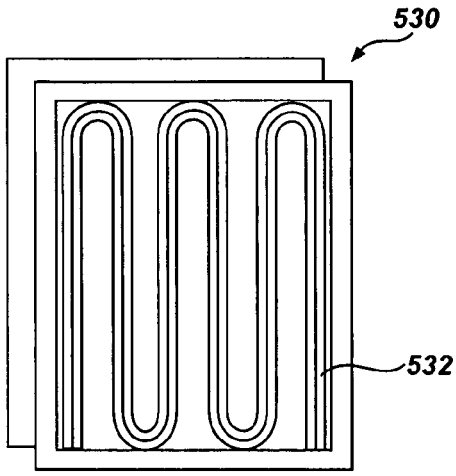
Figure 86:
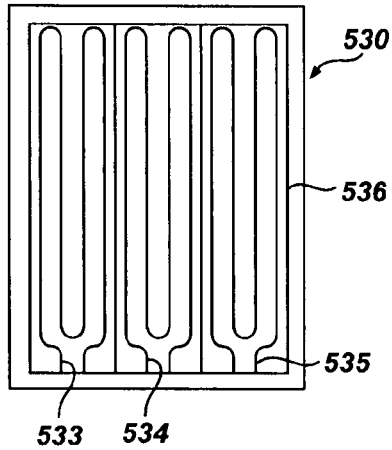
Figure 87:
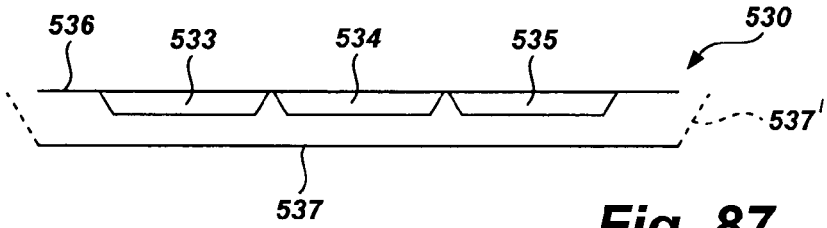
Figure 88:
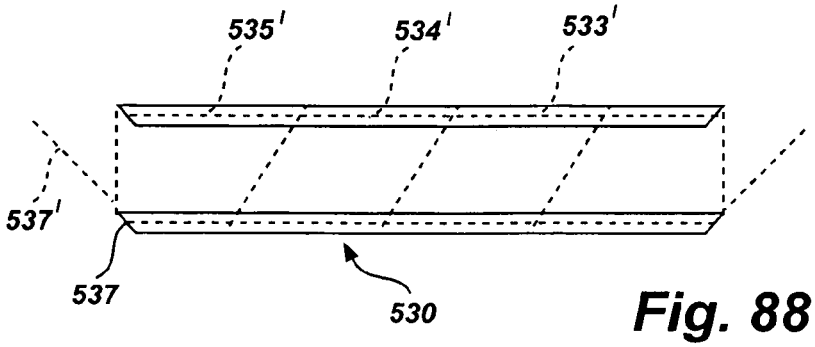
Figure 89:
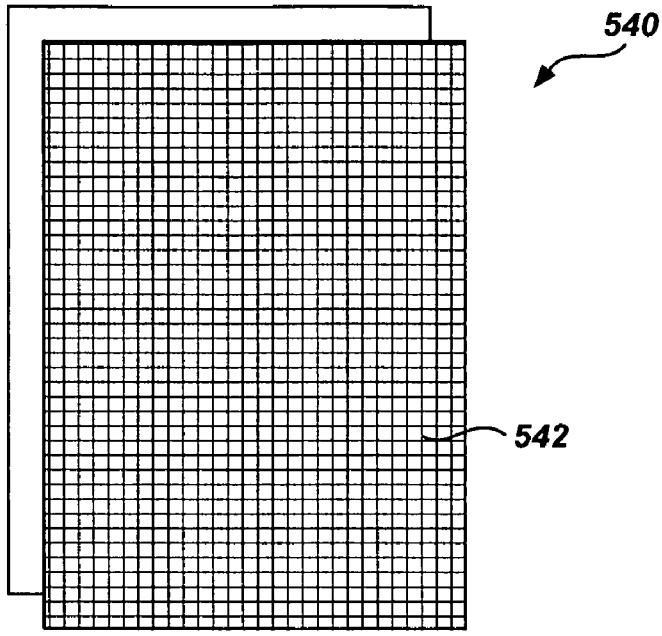
Figure 90:
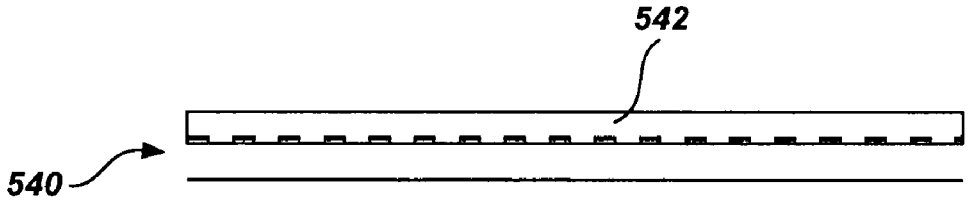
Figure 91:
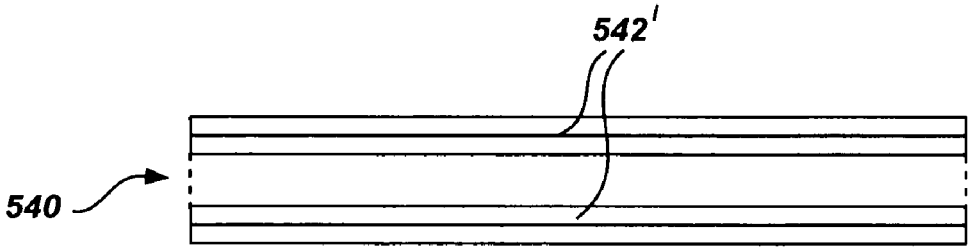
Figure 92:
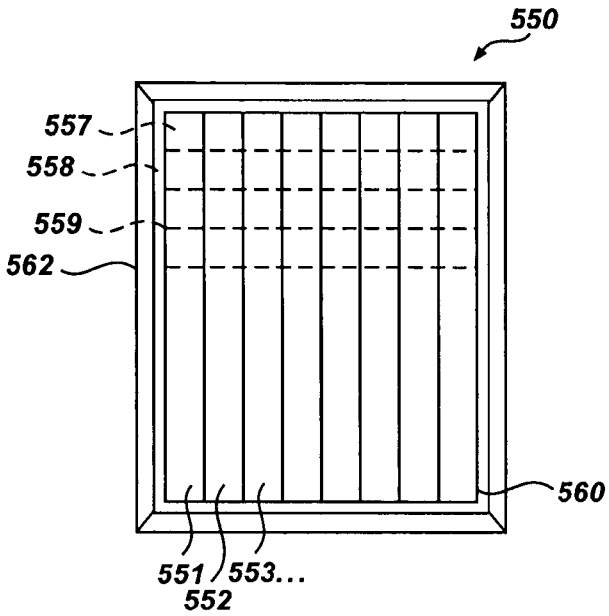
Figure 93:
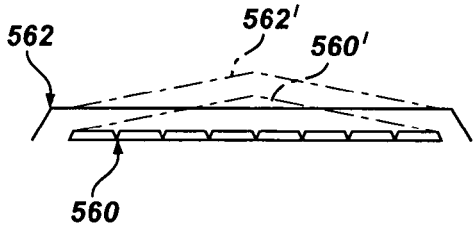
Figure 95:
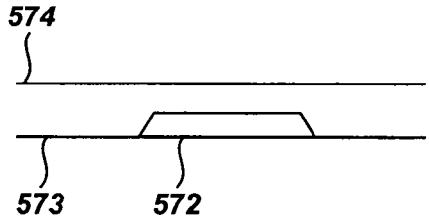
Figure 94:
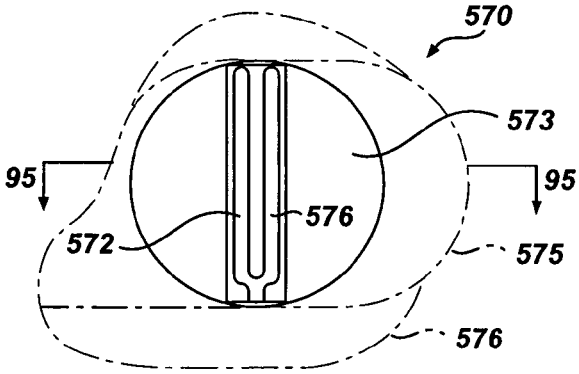
Figure 96:
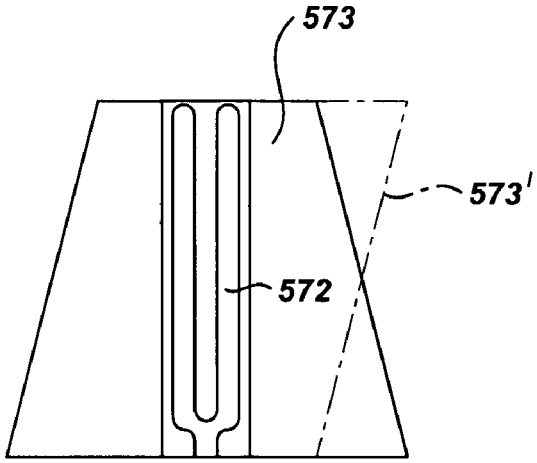
Figure 97:
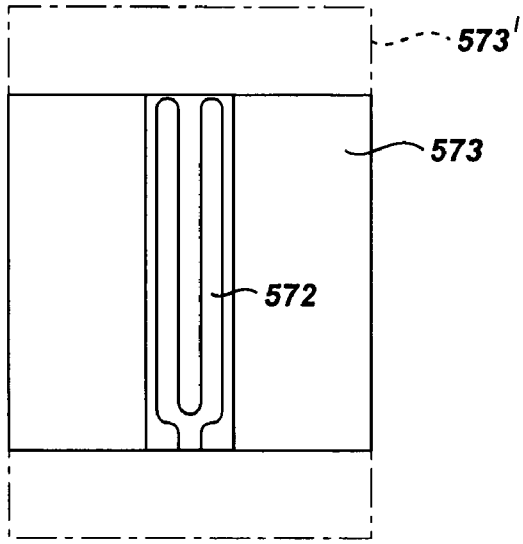
Figure 98:
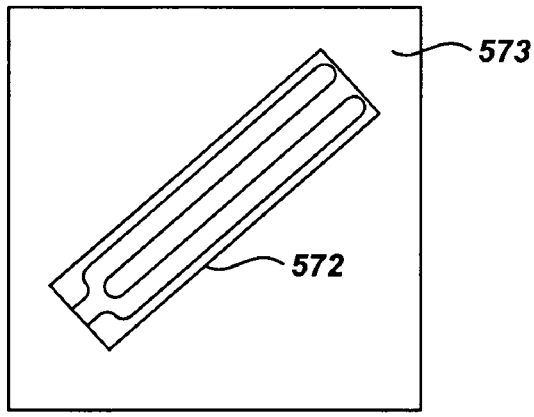
Figure 99:
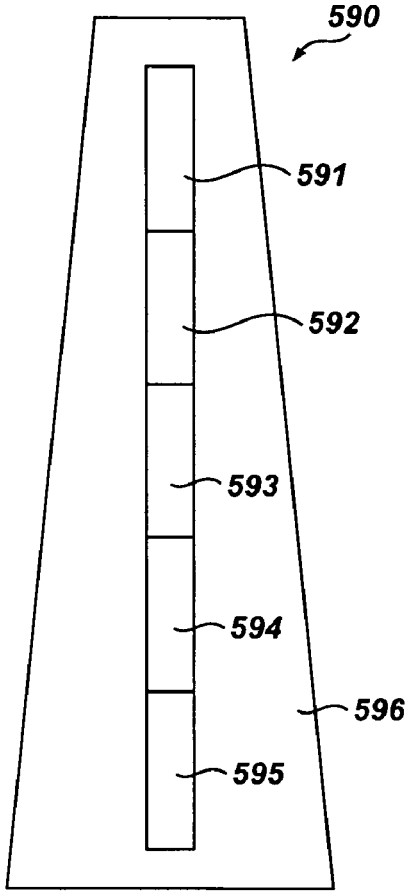
Figure 100:
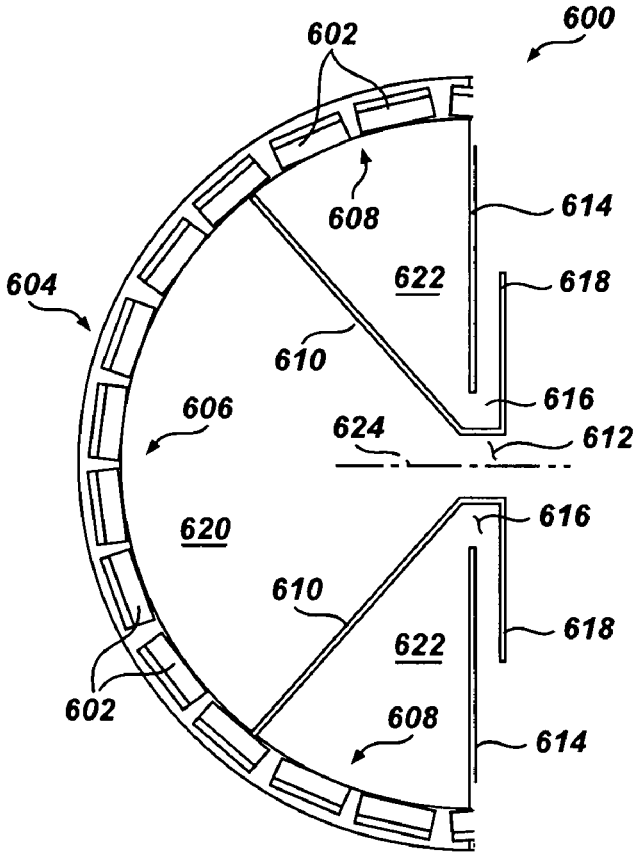
Figure 101:
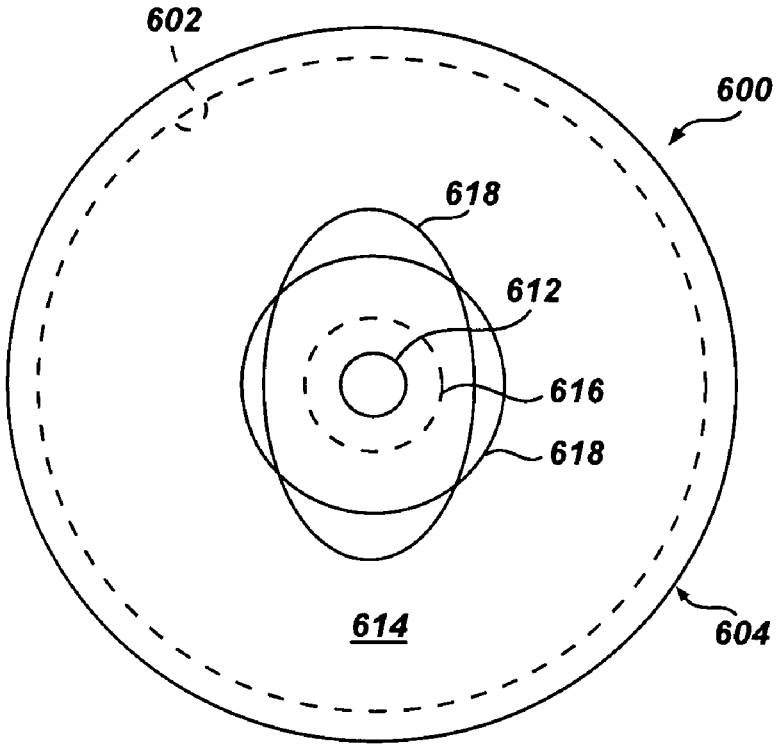
Figure 102:
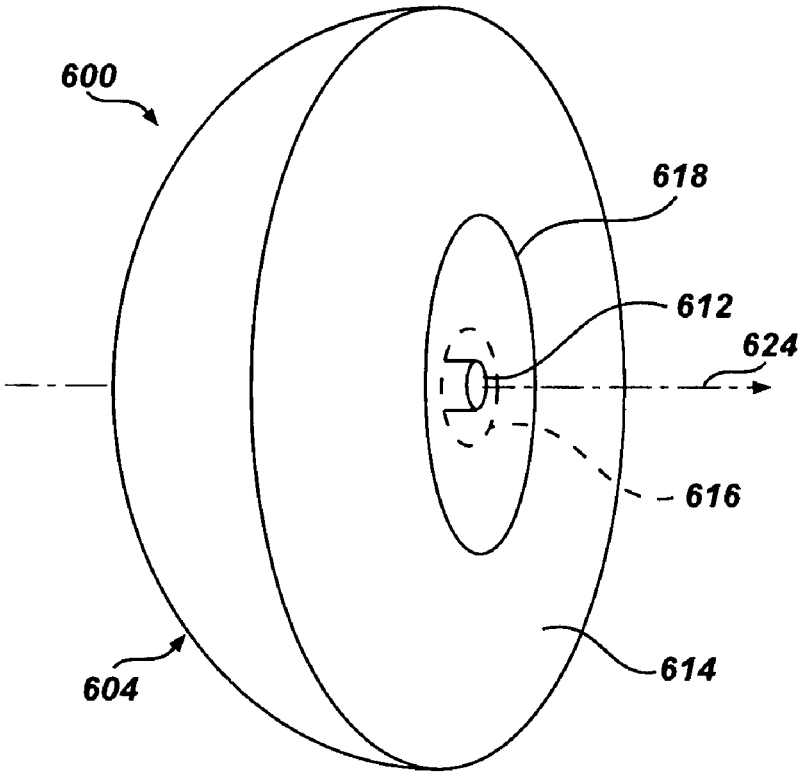

FIG. 34*a* is a schematical cross section view of another example embodiment;

FIG. 35 is a schematical cross section view of another example embodiment, alternative example structural configurations being shown in outline;

FIG. 36 is a schematical cross section view of another example embodiment, additional or alternative structural features being shown in outline;

FIG. 37 is a schematical cross section view of another example embodiment;

FIG. 38 is a schematical cross section view of another example embodiment, a hypothetical polar plot of a given SPL of output being superimposed on the figure to illustrate its directionality;

FIG. 39 is a schematical cross section view of another example embodiment;

FIG. 40 is a schematical cross section view of another example embodiment;

FIG. 41 is a polar plot of SPL in a horizontal plane (but which holds for all planes through the acoustic axis) for the emitter example shown in FIG. 27; and, FIG. 42 is a polar plot of like kind for the emitter example shown in FIG. 28;

FIG. 43 is a schematic side crossectional illustration of an example embodiment;

FIG. 44 is a schematic side crossectional illustration of an example embodiment;

FIG. 45 is a schematic side crossectional illustration of an example embodiment;

FIG. 46 is a schematic side crossectional illustration of an example embodiment;

FIG. 47 is a schematic side crossectional illustration of an example embodiment;

FIG. 48*a* is a schematical cross section view of another example embodiment;

FIG. 48*b* is a schematical cross section view of another example embodiment;

FIG. 49 is a schematic side crossectional illustration of an example embodiment;

FIG. 50 is a schematic side crossectional illustration of an example embodiment;

FIG. 51 is a schematic side crossectional illustration of an example embodiment;

FIG. 52 is a left front perspective view of another example embodiment;

FIG. 53 is a schematic side crossectional illustration of the example embodiment shown in FIG. 52 taken along line 53-53 in FIG. 52;

FIG. 54 is a side crossectional schematic illustration of an emitter in one example embodiment configured for wider band directional response using an electronic crossover and which may also include electronic equalization;

FIG. 55 is a diagram including an SPL vs. Frequency response plot for the respective portions of the device, the more narrow bands at which they produce directional sound and the envelope(s) in which sound can be directionally produced across a wider band of frequencies by taking advantage of overlapping of the more narrow bands by crossover, and in one example narrowing the gaps between the more narrow bands by equalization;

FIG. 56 is a schematic broken out portion illustration of two broken-out portions of emitter examples comparing dipole and two monopole implementations;

FIG. 57 is a schematic sectional illustration of two emitter examples comparing dipole and monopole implementations;

FIG. 58 is a schematic crossectional illustration of an example embodiment using folded tube waveguides and two monopole transducers;

FIG. 59 is a schematic crossectional illustration of an example using a kind of folded quarter wave pipe and two monopoles;

FIG. 60 is a schematic crossectional illustration of an example using two spaced circular waveguides and a connecting pipe with two monopoles;

FIG. 61 is a variation on the example of FIG. 60;

FIG. 62 is a further variation on the example of FIG. 61;

FIG. 63 is a crossectional example of an example where two circular waveguides are separated and independently activated by two monopoles;

FIG. 64 is a schematical crossectional perspective view of an example embodiment in a narrow band device of smaller size using three monopole transducers;

FIG. 65 is a series of three polar plots of two overlapping acoustic signal regimes and the resulting overall regime;

FIG. 66 is a schematical crossectional perspective view of an example embodiment in a narrow band device of smaller size using two dipole transducers;

FIG. 67 is a series of three polar plots of two overlapping acoustic signal regimes and the resulting overall regime;

FIG. 68 is a schematical crossectional view of an example narrow band device of small size having a long narrow form factor;

FIG. 69 is a is a series of three polar plots of two overlapping acoustic signal regimes and the resulting overall regime;

FIG. 70 is a schematical crossectional view of an example narrow band device of small size having a compact form factor;

FIG. 71 is a schematical crossectional view of an example narrow band device of small size having a compact form factor;

FIG. 72 is a schematical crossectional view of an example narrow band device of small size having a narrow beam output;

FIG. 73 is a series of three polar plots of two overlapping acoustic signal regimes and the resulting overall regime;

FIG. 74 is a schematical perspective view of a wide band device example, variations in shape of baffles are shown in outline;

FIG. 75 is a crossectional schematical view of the example shown in FIG. 74;

FIG. 76 is a schematical front view of a variation of the device shown in FIG. 74 illustrating transducer placement with respect to symmetry of the device;

FIG. 77 is an other example embodiment which is a variation of that shown in FIG. 74;

FIG. 78 is a front schematical view of a stereo pair of emitters such as that shown in FIG. 74;

FIG. 79 is a schematical perspective view of another embodiment in a wide band device using a plurality of transducers, a forward extension of the rear baffle which can be used in one variation (as shown by element 62 in FIG. 4 for example) is shown in outline;

FIG. 80 is a variation on the example shown in FIG. 79;

FIG. 81 is a schematical perspective view of another example wide-band device where transducers cover a forward baffle of two baffles forming a waveguide for a rear wave;

FIG. 82 is a schematical crossectional view of the example of FIG. 81 in an embodiment using dipole transducers;

FIG. 83 is a schematical crossectional view of the example of FIG. 81 in an embodiment using monopole transducers;

FIG. 84 is a schematical perspective view of another example wide-band device where transducers cover a forward baffle of two baffles forming a waveguide for a rear wave, being a variation on the example of FIG. 81 and replacing ordered rows and columns of similar transducers with a non-symmetrical pattern of transducers of different sizes and/or types;

FIG. 85 is a schematical perspective view of another example wide-band device where a transducer covers a forward baffle of two baffles forming a waveguide for a rear wave, the example using a planar magnetic transducer;

FIG. 86 is a schematical perspective view of a variation where three planar transducers are used;

FIG. 87 is a schematical crossectional view of the device of FIG. 86 using dipole transducers;

FIG. 88 is a schematical crossectional view of the device of FIG. 86 using monopole transducers;

FIG. 89 is a schematical perspective view of another example wide-band device where a transducer covers a forward baffle of two baffles forming a waveguide for a rear wave, the example using an electrostatic transducer;

FIG. 90 is a schematical crossectional view of the device of FIG. 89 using a dipole transducer;

FIG. 91 is a schematical crossectional view of the device of FIG. 889 using two monopole transducers;

FIG. 92 is a schematical perspective view of another example wide-band device where a transducer covers a forward baffle of two baffles forming a waveguide for a rear wave, the example using a number of planar form transducers;

FIG. 93 is a crossectional schematical view of the example shown in FIG. 92, a virtual position of the elements being shown in outline;

FIG. 94 is a schematical front view of an example embodiment of a wide band device using a planar-form transducer in a double baffle arrangement, a planar magnetic transducer being shown as an example planar form transducer, but other types being substitutable;

FIG. 95 is a schematical crossectional view taken along line 95-95 in FIG. 94;

FIG. 96 is a variation of the example shown in FIG. 94;

FIG. 97 is a variation of the example shown in FIG. 94;

FIG. 98 is a variation of the example shown in FIG. 94;

FIG. 99 is a variation of the example shown in FIG. 94 using a plurality of transducers;

FIG. 100 is a schematical crossectional side view of an example embodiment in a device which can be narrow or wide band wherein a plurality of transducers are arranged in a hemisphere and higher SPL in the directional output is facilitated;

FIG. 101 is a schematical front view of the example shown in FIG. 100; and, FIG. 102 is a side-front schematical perspective view of the example shown in FIGS. 100 and 101.

DETAILED DISCLOSURE OF EXAMPLE EMBODIMENTS OF THE INVENTION

Figure 1:
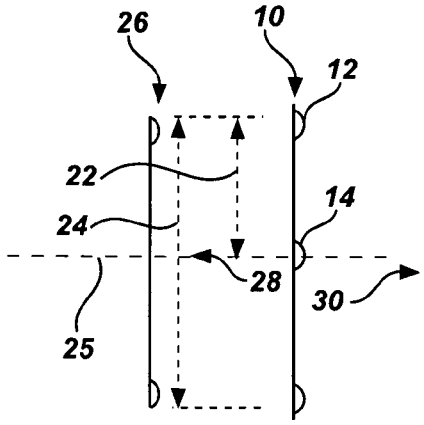
FIG. 1 is a schematical side view of an example acoustic emitter in one embodiment in accordance with principles of the invention.
Figure 2:
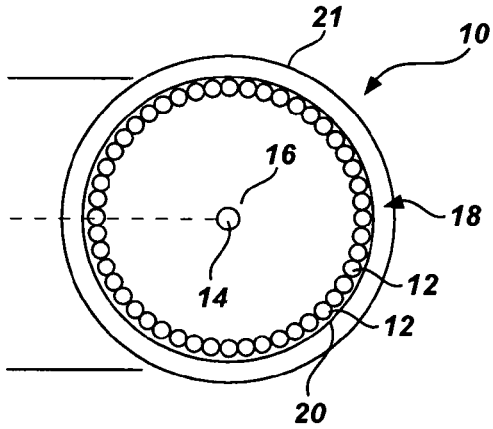
FIG. 2 is a schematical front view of the example shown in FIG. 1.

With reference to FIG. 1 and FIG. 2, a directional audio emitter 10 comprises an array of transducers 12, which can be conventional, such as small speakers of one of the many types known. A central transducer 14 is surrounded by a ring of transducers equidistant from the central transducer. An audio output, which consists essentially of a single tone (being a single frequency or more than one frequency, each bounded within a narrow band of frequencies), can be directionally shaped in a plane by making the sound source two point sources, e.g. 16, 18 located in the plane and separated by one half wavelength. In the example embodiment, the distance between the central transducer and the other transducers forming the ring is one-half wavelength of a tone to be produced by the emitter. In one example, the transducers are carried on a baffle plate 20 so that a radius distance 22 is one-half wavelength of a tone to be projected and a diameter distance 24 is then a full wavelength. It has been found that such an emitter can project a tone, of a single frequency or narrow band of frequencies that corresponds (at least essentially) to a wavelength matching the diameter distance, with high directionality. The output level of the center transducer 14 is made essentially equal to that of all the outer ring of transducers taken together. The transducers are in phase, and selective cancellation and reinforcement, depending on direction of propagation, occurs. If the baffle plate is configured so as to attenuate audio emissions in a negative direction along the acoustic axis 25, the audio output can be directional in a single (positive) direction 30. In one embodiment, the baffle plate extends outward beyond the outer ring of transducers to a periphery 21 which causes output from all the transducers to be subjected to similar conditions very close to the transducers and at the periphery, which can give improved matching of the outputs in a rear direction 28.

As will be appreciated, the one-half wavelength dimension (radius 22) mentioned assumes essentially a single line (circle) source with essentially no thickness, whereas in fact the transducers 14, 16 have physical extent. Other realities different from the theoretical assumptions, such as the need for the central transducer to have much more power than the peripheral ones, and thus perhaps of a different type, as well as manufacturing variations in all aspects of the device (not just the transducers), and the like, can make the actual performance vary from the predicted performance, as is well known and appreciated by practitioners in the art. Nevertheless, the basic assumptions have been found to hold, and can be verified empirically.

Moreover, returning to discussion of the illustrated embodiments, additional configuration aspects can be varied to enhance directionality or to enhance output SPL. In one embodiment, a gradient scheme can be used. When a second emitter array 26 is used (which second array is configured similarly to the first and positioned one-quarter wavelength behind the first emitter 10) and phase-leads the forward emitter, a baffle effect is created when the emitters are run one-quarter wavelength out of phase. As is known in the art gradient systems can create the effect without using or depending upon a physical baffle. This is because in the negative direction 28 the output directly cancels, while in the positive direction 30 the output from the two emitter transducer arrays is in phase and thus is additive. In another embodiment, a physical baffle can be used and the two emitters are run at different levels (the back emitter having less SPL) so that the rear emitter just cancels residual audio output from the front emitter that circumvents the physical baffle. An improvement over such a gradient system is obtained in the present example is obtained however, because transverse cancellation (e.g. ninety degrees off axis) is improved. Most gradient systems are not sufficiently out of phase side-to-side to produce good cancellation in that directions, being about one quarter wavelength offset only. The example arrays each inherently cancel side-to-side, and thus obtain an improved result in a gradient configuration. This allows power to be close to doubled, quadrupled, etc. by staking up the arrays along the acoustic axis. The reason a full doubling etc. is not obtained is that this arrangement does not allow the path distance from the central transducer 14 and the outer transducers 12 to a point in the far field to be equal, and thus a phase shift occurs. This latter point will be better understood with discussion of the following further examples. Moreover, after one becomes familiar with the next example it will be apparent that the forgoing example can be modified to eliminate the central transducer by changing the size (diameter) of the outer ring of transducers 12, without total loss of the side cancellation effect.

Figure 3:
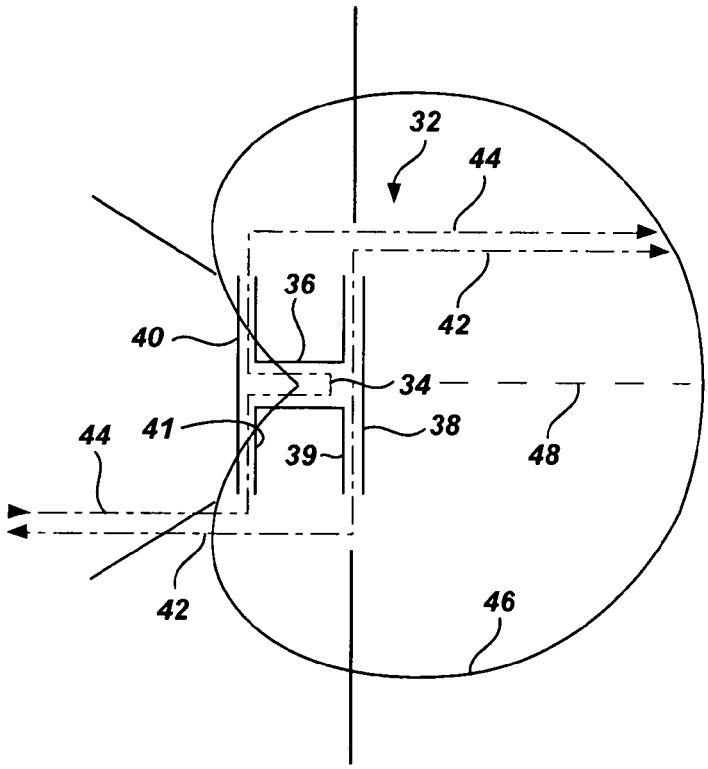
FIG. 3 is a schematical cross section view of an acoustic emitter in another example embodiment, a hypothetical polar plot of a given SPL of output being superimposed on the figure to illustrate its directionality.

With reference now to FIG. 3, it will be appreciated that a similar effect can be obtained in another example emitter 32 using a single transducer 34. The transducer is positioned in a forward end of a quarter-wave pipe 36. Circular disks 38, 39, 40, 41 closely spaced and positioned at the front and rear of the quarter-wave pipe are between one-half and one full wavelength in diameter (e.g. 0.765 wL), and form circular line sources around their peripheries. As will be appreciated by those skilled in the art the pipe is referred to as a quarter-wave pipe, but can actually have a different length (depending on the spacing between disks, for example, and other real-world factors such as reflectivity of materials, etc.) Sound 42 from the front disk pair is reinforced by sound 44 from the back pair in the forward direction, and is cancelled in the rearward direction, giving a polar plot such as the example hypothetical cardioid-shaped plot 46 shown superimposed over the device with respect to the acoustic axis 48. Since the emitter is symmetrical around the acoustic axis, the directionality holds in all planes through the acoustic axis. As will be appreciated, this symmetry of device and acoustic effect holds for all the symmetrical examples shown in the figures (including that of FIGS. 1 and 2 when a sufficiently high number of transducers are used so as to simulate a circular sound source).

Figure 4:
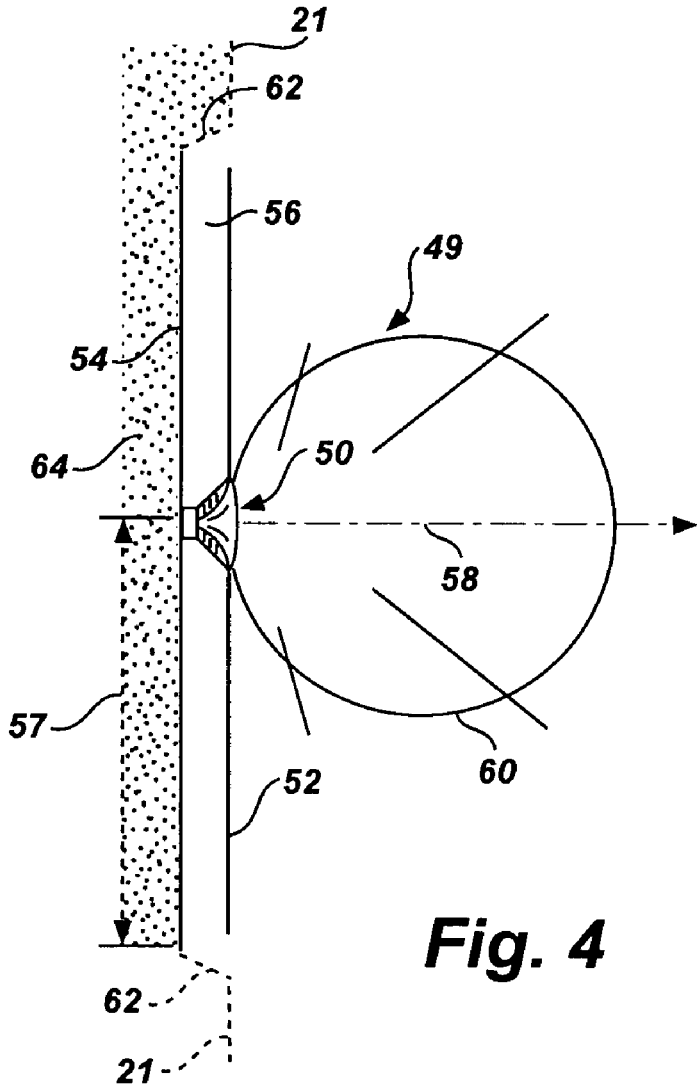
FIG. 4 is a schematical cross section view of another example embodiment, a hypothetical polar plot of a given SPL of output being superimposed on the figure to illustrate its directionality.

With reference now to FIG. 4, in another example emitter 49 a transducer 50 is surrounded by two circular plates 52, 54 which are each about one wavelength in diameter. This creates a circular sound source at the periphery 56 that is spaced one-half wavelength 57 from the (central) transducer. It will be appreciated that the transducer is operating in a dipole mode and that the sound emanating from the circular sound source at the periphery of the forward circular plate 52 will be in-phase with that emitted directly by the centrally located transducer at far-field locations forward of the emitter along the acoustic axis 58. Thus, the emitter is analogous to the example of FIGS. 1 and 2, and the output cancels at 90 degrees from the acoustic axis. However, this example is simpler in construction, and uses a single transducer instead of many transducers. The sound output will likewise be directional for the reasons explained above, and symmetric about the acoustic axis (as shown by a hypothetical polar plot 60 superimposed on the figure). In one embodiment the rear disk is extended around and brought forward at an outer edge portion 62 around the periphery 21 so that the opening between the plates faces forward, and in another embodiment a sound-attenuating material 64 can be used to increase the baffle effectiveness of the rear plate. The forwardly extending portion can terminate even with the front plate, or can turn back outward and extend as a baffle further outward to the peripheral edge, 21 as shown in outline.

Figure 5:
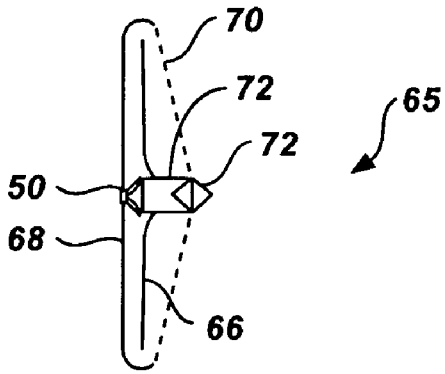
FIG. 5 is a schematical cross section view of another example embodiment.
Figure 6:
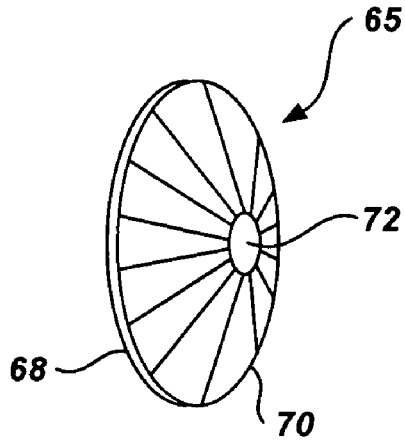
FIG. 6 is an oblique perspective view of the example emitter shown in FIG. 5.

With reference to FIGS. 5 and 6, the example just discussed can be further modified in another example emitter 65 by modifying one or both of the front and rear disks, 66, 68, respectively, to provide a flare, such as an exponential flare, or other flare configuration, different from that flare (e.g. that of the example of FIG. 4) which would result from keeping the distance between the disks constant. Furthermore, a screen 70, or other acoustically transparent cover, can be provided to protect the transducer 50 from the environment, and/or from washing sprays, flying objects, etc. which may be inherent in the environment of the application to which the emitter is directed, for example a back-up warning beeper for semi-tractor-trailer trucks, dump trucks and other heavy equipment (including construction equipment of various kinds), garbage collection vehicles, and fork lifts, to name a few examples.

In one example, a central protective cone 72 and louvers 74 can be provided. This cone particularly shields the location of the transducer 50. This is in addition to the protection the screen 70 affords. In one embodiment this cone can be given a phase-plug shape, and can act cooperatively with the other structure to mitigate some of the interference with the sound pathways that its own presence creates.

Figure 7:
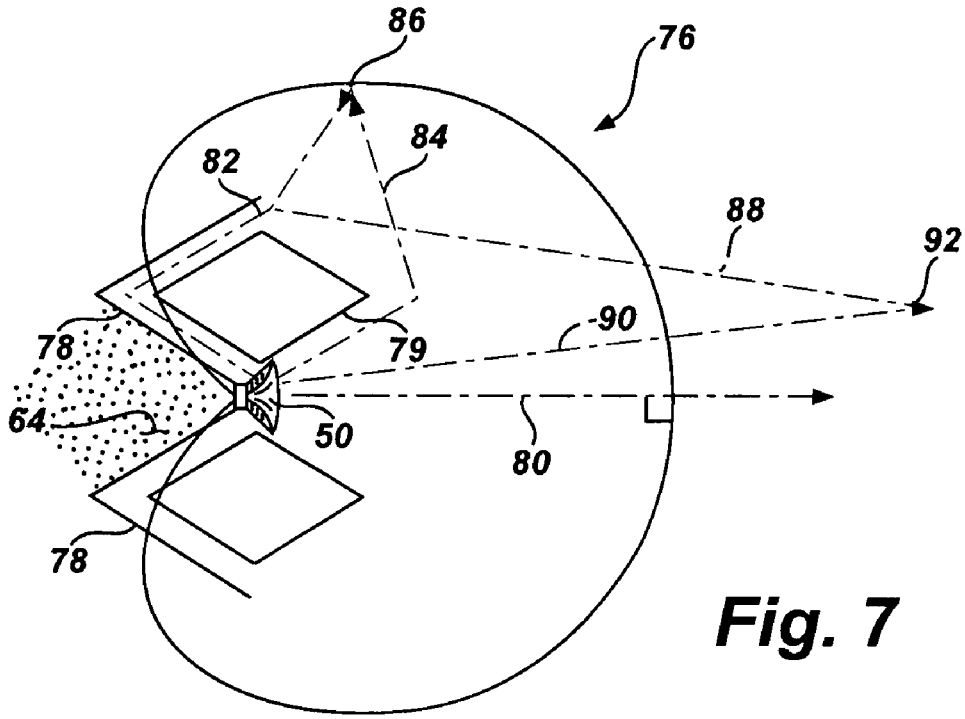
FIG. 7 is a schematical cross section view of another example embodiment.

Turning now to FIG. 7, in another embodiment which is a modification of the configuration discussed above in connection with FIG. 4, the emitter 76 can be modified so as to have a smaller diameter overall, while still providing one-half wavelength difference sound pathways for the functionality described above. By "folding" the rear plate 78 and modifying the front plate to be a rotated polygon 79 (rotated about the acoustic axis 80) the sound waves follow pathways 82, 84 of equal length to a point 86 which is 90 degrees off axis in the far field so that they cancel (at least in part), and of lengths 88, 90 differing by one-half wavelength to a point 92 on axis in the far field, so that sound from the dipole transducer is in-phase there. Pathways to the rear far field ideally will be of equal length so as to provide good cancellation, thereby quieting the emissions to the rearward. In one example, sound absorbing material 64 can be used as discussed above in this configuration as well.

Figure 8:
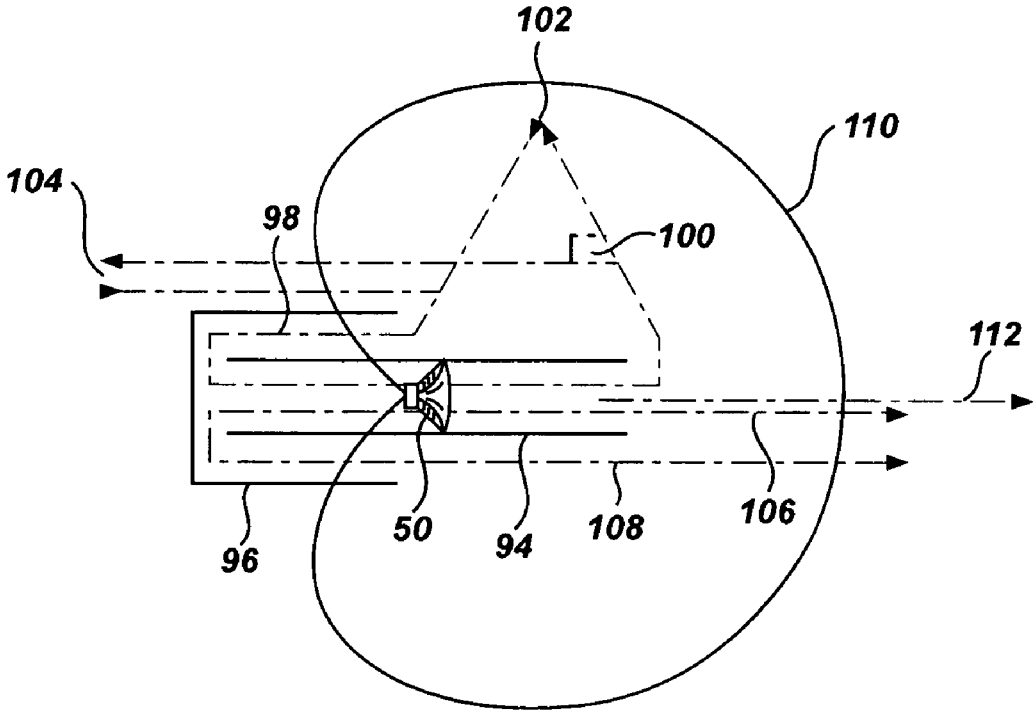
FIG. 8 is a schematical cross section view of another example embodiment.

With reference to FIG. 8, in another example embodiment of the invention the folding is taken to a point where the forward and rearward plates discussed above become instead inner and outer concentric pipes 94, 96, respectively. The outer pipe is closed at a back end to create a folded pathway 98 for the rear wave from the dipole transducer 50. At 90 degrees off-axis, this pathway is matched in length by the pathway 100 of the front wave to a point 102 in the far field in that direction, where they cancel at least in part. The same situation obtains behind the emitter 104 of this example, the matching path length giving a null by cancellation of the front wave by the back wave. In the forward direction sound pathways 106 and 108 of the front and back waves, respectively, differ by one-half wavelength and so the sound is in-phase. This gives the hypothetical pattern 110 around the acoustic axis 112 as shown.

Figure 9:
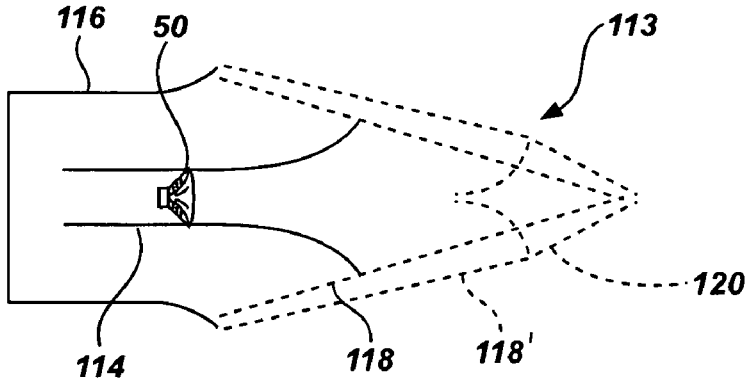
FIG. 9 is a schematical cross section view of another example embodiment; and, FIG. 10 is an oblique perspective view of the example emitter shown in FIG. 9.
Figure 10:
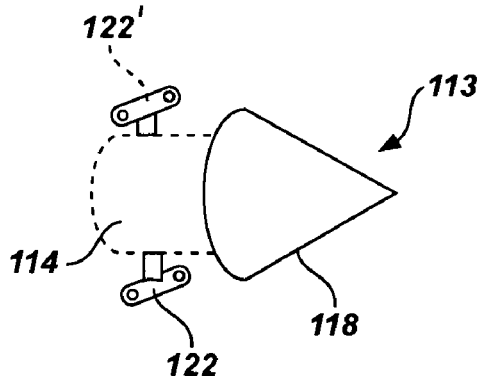

Turning to FIGS. 9 and 10, in another example emitter 113, which is a variation of that, just discussed, the pipes 114, 116 can be configured to provide a flair for improved efficiency, and/or to alter directivity parameters influenced by flair (wider or narrower dispersion and sound pressure level due to flair geometry). A screen 118 or 118' can be provided to protect the transducer 50 as discussed above, as can a cone 120 (or "plug") as discussed above. A mounting bracket 122 or 122' can be included so that the emitter can be mounted to a surface (not shown).

Figure 11:
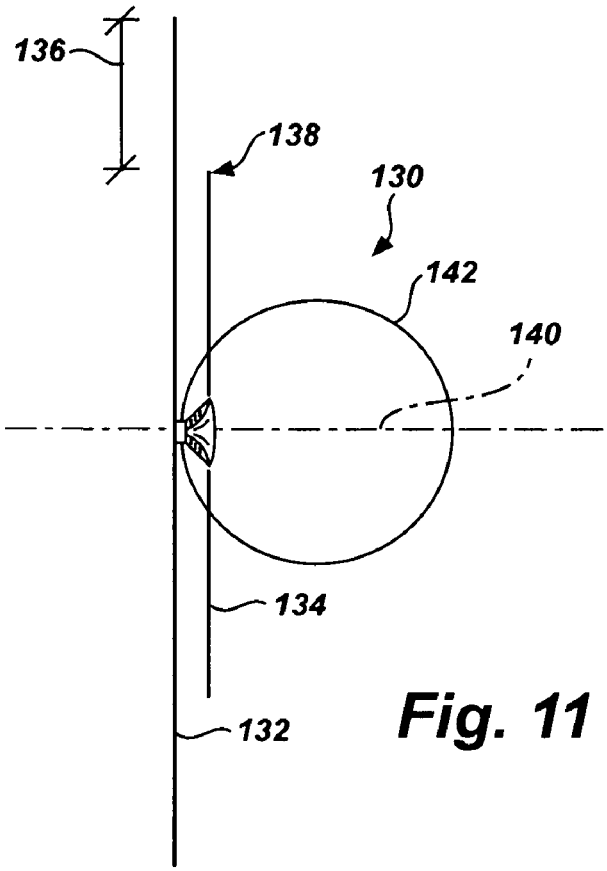
FIG. 11 is a schematical cross section view of another example embodiment, a hypothetical polar plot of a given SPL of output being superimposed on the figure to illustrate its directionality.

With reference to FIG. 11, in another example embodiment an emitter 130 is mounted so that the back plate 132 comprises a baffle that extends well beyond the outward circular extent of the front plate 134. The baffle in one example can be a large surface on which the emitter is mounted. For example if the emitter is mounted on a wall, for example a back side wall of a truck trailer, the baffle will be provided by the surface on which it is mounted. In another embodiment the back plate simply extends outward some distance 136 which is at least a substantial fraction of the frequency of the tone to be emitted, from the outer periphery 138 of the front plate. This controls the pathways of the front and back waves so that they are more equal in length into the far field in the negative direction along the acoustic axis 140, and also helps equalize the levels of the front and back waves at that location, to improve cancellation and obtain an improved null in the rear direction. This results in an improved directionality as illustrated by a superimposed hypothetical polar plot 142 of a sound level value which can be obtained using the configuration.

In obtaining improved directionality, and specifically in improving the cancellation to the sides and rearward (i.e. at 90, 180, and 270 degrees and azimuths therebetween, taken from the acoustic axis) it has been found that managing the difference in level between the front and back waves as well as configuring for phase difference effects is important. To illustrate—it has been found in some examples of the configuration shown in FIG. 4, without the extending portions of the back plate (e.g. obliquely angled forward extensions 62 and/or outwardly extending baffle portions terminating at the outer periphery 21), a rear wave portion of the sound (which is emanating from between the plates 52, 54) measured in the far field rearward (e.g. 180 degrees off the forward acoustic axis) can be about 6 to 10 dB higher in level than that of the front wave, as determined by empirical measurement. This difference in level can give rise to a rear lobe of emitted sound plot (albeit considerably smaller than the front lobe), even though the waves may be essentially completely cancelled.

Likewise it will be appreciated that if the front and back-wave path lengths are not matched, the match in level not be availing in producing a null either. It has been found that some configurations which improve the match in path length degrade the match in level, and vice versa. A desirable end is to find configurations where cancellation is optimized for the application, given the limitations of the geometry. The examples discussed herein are directed to this end. It will be appreciated that depending on whether cancellation to the sides (90 and 20 degrees) or the rear (180 degrees) is preferred, different approaches can be taken.

Returning to discussion of the illustrated examples, providing the baffle, as illustrated by the example of FIG. 11, or by adding the extensions 62 extending the rear plate forward as shown as an alternative in FIG. 4 (with or without further baffle extensions to the periphery 21), provides improved cancellation as just discussed. This is accomplished by one or both of better equalizing the level of the front and back waves, and also by (at least incrementally) improving the matching relationship in the path lengths of the front and back waves of the dipole for better cancellation rearward.

Figure 12:
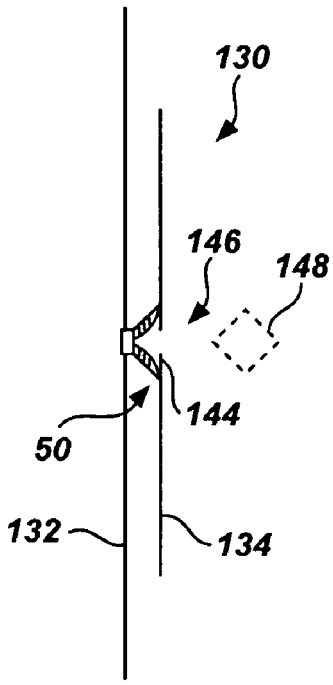
FIG. 12 is a schematical cross section view of another example embodiment, additional possible features being shown in outline.

In other examples, e.g. as shown in FIG. 12 (some as possible added features), other variations for wave pathway modification are illustrated. In one example embodiment the front plate (or structure carried by the front plate) extends inward forming an inwardly overhanging portion 144 over the front of the transducer 50. This results in forming a smaller opening 146 for the front wave. In another example, a structure 148 is positioned over the transducer, which can be configured to act like a phase plug, again to control path length.

Figure 13:
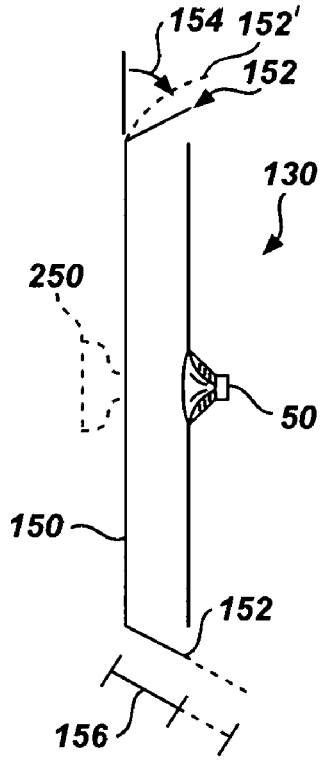
FIG. 13 is a schematical cross section view of another example embodiment, additional possible features being shown in outline.

With reference now to FIG. 13, in an example akin to alternatives of FIG. 4 discussed above, the rear plate 150 is integral with forwardly folded extension portions 152, which are disposed at an oblique angle 154 to the front and back plates. For example the angle can be in the range of 20 to 80 degrees. An angle of 45 degrees has been used with success, for example. A length 156 of the extension portions can be chosen to provide the match in level of the front and back waves and control path length as discussed. In one embodiment the extension portion 152' can be given a curved shape, rather than the straight section (frustoconical) configuration 152 before described. For example the extension portion can be made parabolic in shape with a focus at the transducer 50. In this illustrated embodiment, the transducer 50 is flipped 180 degrees, which better accommodates providing a second transducer 250 in one example discussed more particularly below. A forward facing configuration for the transducer, such as that shown in FIG. 27, can be used.

Figure 14:
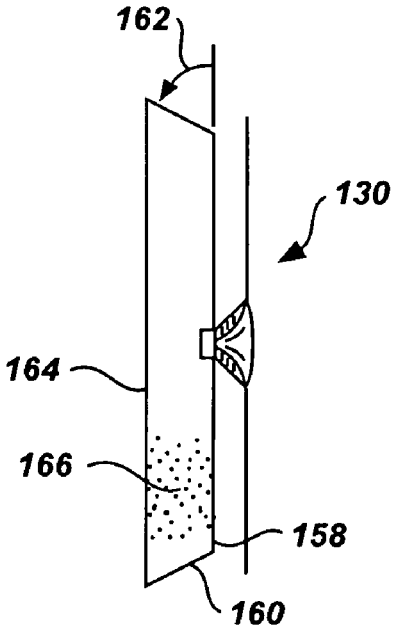
FIG. 14 is a schematical cross section view of another example embodiment.

With reference to FIG. 14, in another example the back plate 158 is provided with backward extending portions 160.

These can be disposed at an oblique angle 162 (e.g. 60 degrees) and are configured to provide the control of front and back wave comparative phase and level, as discussed above, to give improved cancellation rearward. In one example the back of the emitter 130 can be closed by a closure plate 164. In one example sound absorbing material 166 can be included, for example placed intermediate the back plate 158 and the closure plate in that example. With reference to FIGS. 27 and 28, variations of the example configurations just discussed are illustrated in greater detail; and further information regarding these examples will be set out below.

Figure 15:
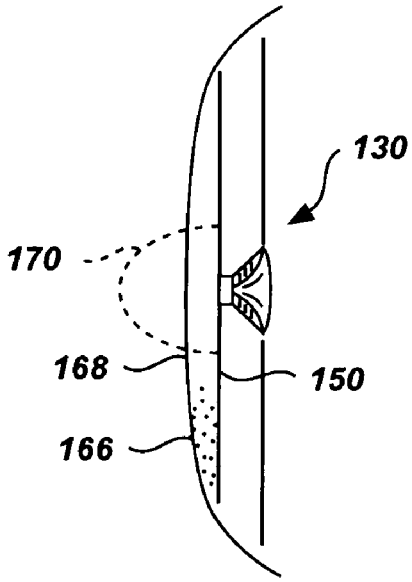
FIG. 15 is a schematical cross section view of another example embodiment.

With reference to FIG. 15, in another example an emitter 130 (similar to the example shown in FIG. 13) is modified to include a back closure plate 150 and a space between the back plate and the closure plate. Sound absorbing material 166 can be provided between the back plate 150 and the closure plate. In another embodiment (not shown) the closure plate is omitted and the sound absorbent material is carried by the back plate. In another example embodiment, rather than a cover plate a cover 170 can be placed over the back plate in the area of the transducer only. These measures can be effective in reducing direct radiation of sound by the back plate (or any part of the transducer which is intimately adjacent the back plate, or which extends through it).

Figure 16:
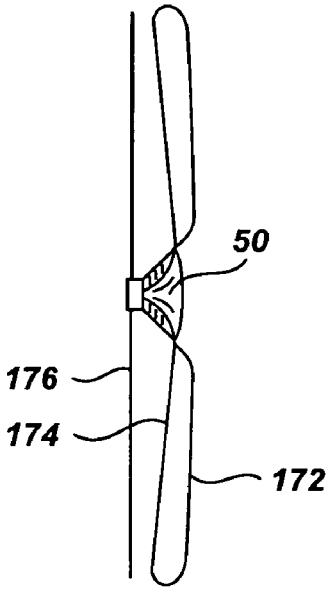
FIG. 16 is a schematical cross section view of another example embodiment.
Figure 17:
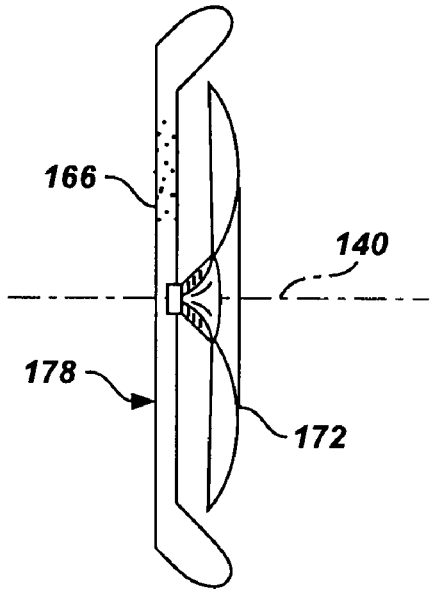
FIG. 17 is a schematical cross section view of another example embodiment.

Turning to FIG. 16, in another embodiment a front portion 172 is less plate-like, and can have a rounded configuration to guide sound waves from the transducer 50. It can, for example control the flair of the rear wave guide space 174 between the front portion and a back plate 176, can provide a flair for the front wave, and can control relative path lengths for the front and rear waves to front, side and rear locations far field. Further variations can be seen with reference to the example of FIG. 17, wherein a rear portion 178 (which also can be filled with a sound deadening material 166) can likewise be shaped to control the path of the front and rear waves, particularly to the far field rearward. As with all the examples discussed, the emitter and these front and back portions are symmetric about the acoustic axis 140 in the illustrated examples.

Figure 18:
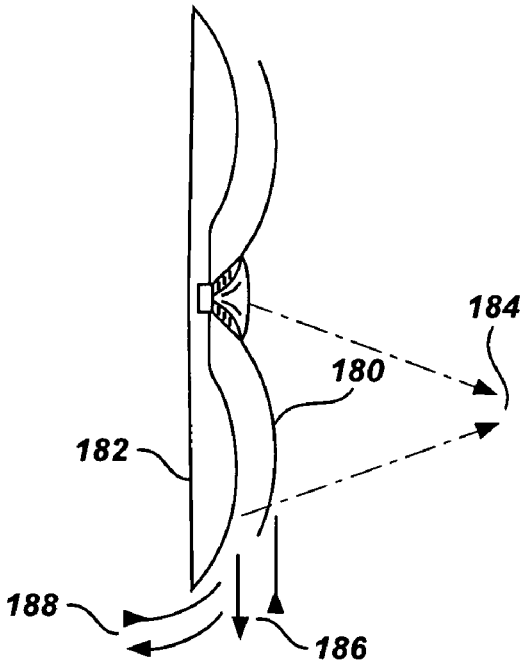
FIG. 18 is a schematical cross section view of another example embodiment.

Another variation is shown in the example illustrated in FIG. 18, wherein a front plate 180 is configured with a flair and rounded shape, and cooperates with a rear portion 182 to provide front wave and back wave pathways of desired lengths and configurations. This is so that the front and back wave are in-phase at a forward location 184, and out of phase at side and rear locations 186, 188, respectively. This provides the phase relationships for improved directionality, as is the case with the previous examples of FIGS. 11-17 discussed above, and will be the case with the following examples illustrated in FIGS. 19-21.

Figure 19:
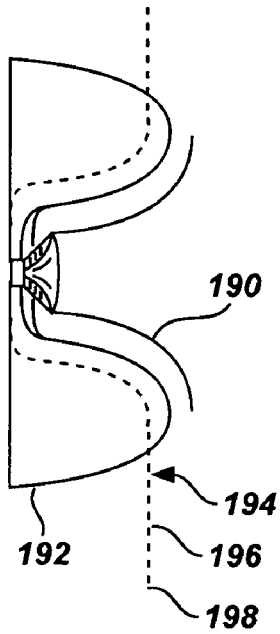
FIG. 19 is a schematical cross section view of another example embodiment, another example embodiment shown alternatively in outline.

With reference now to FIG. 19, the flair and shaping provided are more pronounced, with the front plate 190 flaring more, and the back portion 192 having more depth. It will be appreciated with increased flare forward the level can be unbalanced forward, but since the front and rear waves are in-phase and additive, this is not objectionable. Since to the rear of the emitter the front wave is usually down in level with respect to the back wave, an increase in the level of the front wave can improve level match in one embodiment. In another example, shown in outline as alternative in the figure, a back portion 194 having baffle-like extensions 196 and outer terminations 198, is provided rather than the more bulbous configuration. The back portion 194 in the later case is more plate-like and provides a baffle, rather than having the deep thickness but less outward plate-like projection distance just discussed.

Figure 20:
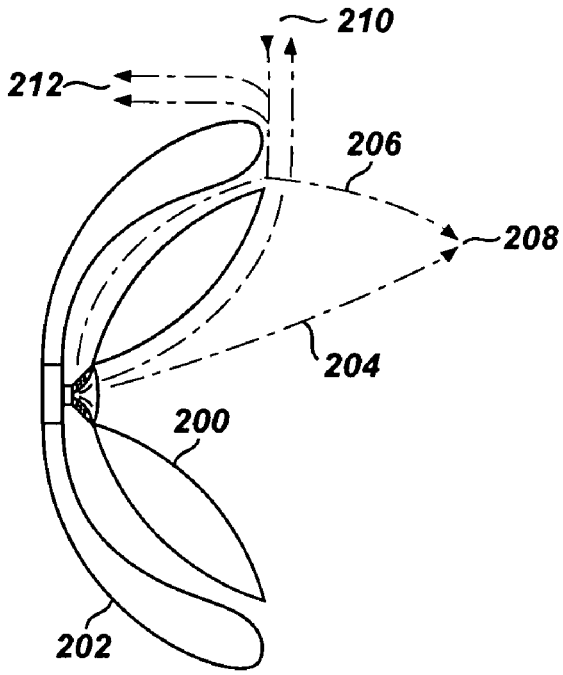
FIG. 20 is a schematical cross section view of another example embodiment.
Figure 21:
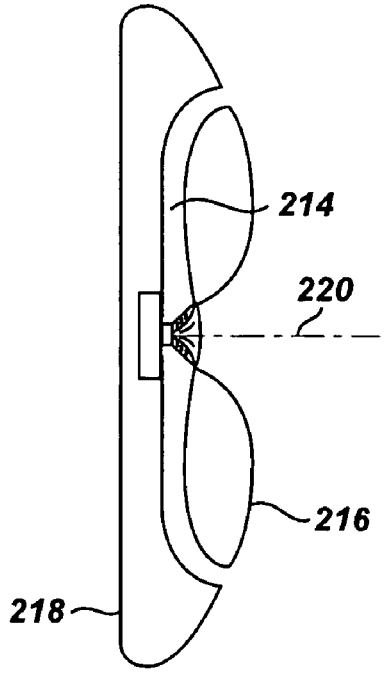
FIG. 21 is a schematical cross section view of another example embodiment.

In the example shown in FIG. 20, both the front portion 200 and rear portion 202 have thickness and curved configurations. A direct path 204 forward and a longer pathway 206 for the rear wave differ by one half of a wavelength to give an in-phase condition at a forward location 208. Whereas, path lengths to a side location 210 and rear location 212 are approximately equal. Another variation on this theme is shown in the example of FIG. 21. This later example embodiment comprises a configuration which is between that of FIG. 17 and that of FIG. 20. However, it retains a more orthogonal relationship of the rear wave pathway in the back wave guide space 214 between a front portion 216 and rear portion 218 with respect to the acoustic axis 220. This can simplify design which is (in this connection) based on providing a difference in pathway lengths of a desired magnitude with respect to a wavelength of the narrow frequency band or single frequency to be directionally emitted.

Figure 22:
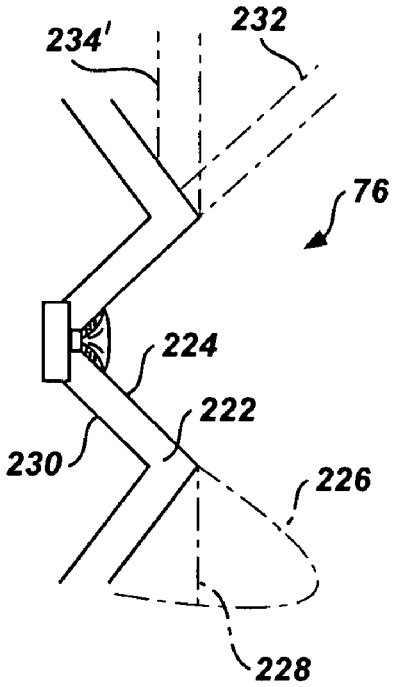
FIG. 22 is a schematical cross section view of another example embodiment, other example embodiments shown alternatively in outline.
Figure 23:
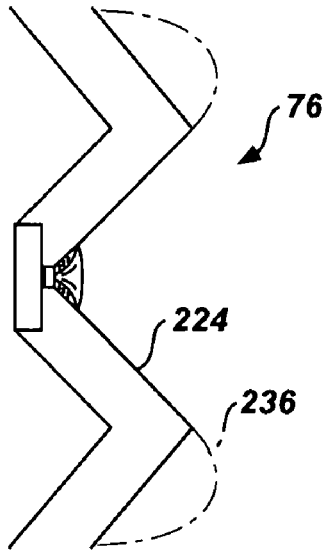
FIG. 23 is a schematical cross section view of another example embodiment, another example embodiment shown alternatively in outline.

With reference now to FIG. 22, a variation on the example embodiment of FIG. 7 is illustrated. The folded configuration of the back wave guide space 222 results in a more compact configuration in that the emitter does not have to be a full wavelength in diameter. Variations include having the front plate 224 continue to extend forward by forward extensions 226, or to the side to form baffle portions 228. These can form a separation between the front wave and back wave at the side of the device, or, as shown alternatively at the top of the figure the back plate 230 can have corresponding extension portions 232, 234 which follow the configuration of the front plate. The configuration chosen will depend on which of side or rear cancellation is more of a priority, for example. A further variation is shown in the example of FIG. 23, where the front plate 224 can be altered to have a curved configuration and thickness, for example a curved front surface 236 and unaltered rear surface.

Figure 32:
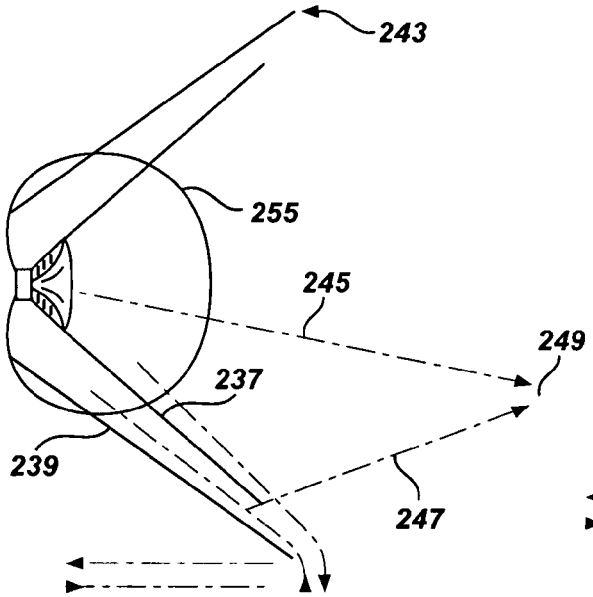
FIG. 32 is a schematical cross section view of another example embodiment, a hypothetical polar plot of a given SPL of output being superimposed on the figure to illustrate its directionality.

Additional variations on this theme will be appreciated with reference to FIGS. 32-35. The example shown in FIG. 32 is similar to one of the variations shown in FIG. 22. The front plate 237 is angled forward, as is the rear plate 239. The rear plate extends beyond the front plate however, and at a periphery 243 both the rear wave path and the front wave path have to turn the corner at the same location to reach the rearward far field. The configuration thus accommodates forward addition of the front and back waves by making the respective pathways 245, 247 to a front location 249 differ in length by one-half wavelength. The pathways to the sides and rear are essentially equal in length for the front and rear wave, and thus cancellation can occur. The extension of the rear plate helps equalize the level in the rearward direction far field as well. A superimposed hypothetical level plot 255 illustrates the effect.

Figure 33:
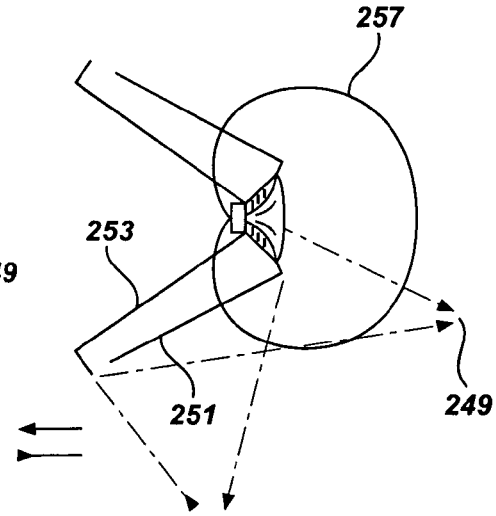
FIG. 33 is a schematical cross section view of another example embodiment, a hypothetical polar plot of a given SPL of output being superimposed on the figure to illustrate its directionality.

Another variation is illustrated by the example shown in FIG. 33. This time the front and rear plates 251, 253, respectively, angle backward. In this embodiment the front and back wave are made in phase at a forward location 249 by difference in path length of one half wavelength as discussed above, and cancel rearward, and partially cancel to the side. A hypothetical level plot 257 illustrates the effect. With reference to FIG. 34, by wrapping the front plate 259 completely around rearward and collapsing the back plate on itself to form a cone 261 a roughly equivalent system can be made. Carrying the concept further, with reference to FIG. **34*a* the cone can be eliminated, and some sound absorbent material 263** can be used to balance the level of the back wave to the front wave to get improved cancellation rearward.

With reference now to FIG. 35, a system roughly equivalent to the example of FIG. 32 can be made by turning the front plate into a doughnut-shaped cylindrical front element 265 and wrapping the rear plate 267 forward to form cylindrical forward extension 269, a forward extent of which comes even with the front element. In another example embodiment (265') the front element can be given curved surfaces to provide a smoother transition and a flair for the front wave. In this embodiment the path lengths for the front and rear waves can be made essentially the same to the rear and to the sides for cancellation, but different by one-half wavelength forward for a cumulative (reinforcing) effect there.

Figure 24:
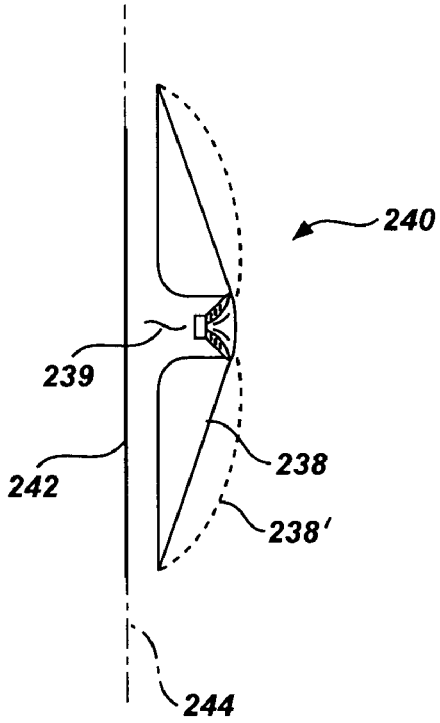
FIG. 24 is a schematical cross section view of another example embodiment, other example embodiments shown alternatively in outline.

Referring now to FIG. 24, in another embodiment a front portion 238 is configured to provide a rear wave guide space 239 that extends rearward then curves outward. The back plate 242 can be made to extend outward by baffle portions 244, or can be eliminated altogether by mounting the emitter on a large relatively flat surface as discussed above. A curved configuration 238' for the front portion is also illustrated to modify path length. As will be appreciated this configuration also decreases the diameter of the emitter 240.

Figure 25:
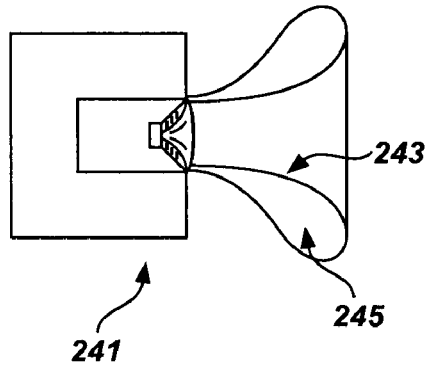
FIG. 25 is a schematical cross section view of another example embodiment.

With reference to FIG. 25, in another example embodiment comprising a variation on the examples shown in FIGS. 8 and 9 an emitter 241 can include a flared pipe portion 243 and lobed configuration providing thickness 245 to the front wave pipe. This alters levels and path distances as discussed above to alter the cancellations to optimize for side or rear cancellation, or some combination thereof, as desired.

Figure 26:
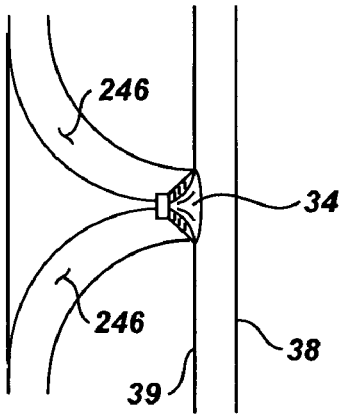
FIG. 26 is a schematical cross section view of another example embodiment.

Turning to FIG. 26, a variation on the example embodiment shown in FIG. 3 is illustrated. Here the path length distances can be adjusted to provide the differences desired, but the rear wave guide space 246 is given a curved configuration (and thus a more gradual flair) rather than a quarter wave pipe and then orthogonal expansion (extreme flair) outward. As will be appreciated, reflections can further complicate the problem (not just in this embodiment, but in all embodiments), but overall the device example of these figures can be made to give a cardioidal level plot such as that shown in FIG. 8, or another shape plot by adjusting the configuration dimensions.

Turning now to FIG. 36, in another example embodiment a further transducer 248 can be added to the front plate 38 of the example embodiment illustrated in FIG. 26. This further transducer is operated in phase with the first transducer 34 so that the output in the forward direction (to the right in the figure) is enhanced. In another example embodiment the relative phases between the transducers can be adjusted to improve side cancellation (albeit at the expense of level forward in one example).

With reference to FIG. 37, in another embodiment a variation of the example illustrated in FIG. 4 includes a primary transducer 50 carried by the front plate 52, which primary transducer can be flipped 180 degrees from that discussed above and shown in FIG. 4 (and is so illustrated flipped in FIG. 37) and a secondary transducer 250 mounted in the back plate 54. The purpose of the secondary transducer is to provide an ability to adjust the nulls to the side and rear of the emitter 49. In one embodiment it is essentially identical to the primary transducer. In another embodiment the secondary transducer can be smaller than the primary transducer, since in that case it can be used primarily to provide a fine adjustment on the system primarily defined by the primary transducer and geometry as discussed above.

Moreover in one embodiment the secondary transducer 250 is run in-phase with the primary transducer and adjusted as to level to null the sound in the rearward (left in the figure) direction. It also increases or decreases the level of the sound coming from the back wave guide space between the plates, but provides a canceling wave as well so does not appreciably affect the side null. In another embodiment it is adjusted out of phase to adjust the amplitude of sound emitted from the back wave guide space between the plates, enabling adjustment of the side and rear nulls if desired. In another embodiment it is adjustable as to both level and phase relationship with the primary transducer for purposes of adjustment of the nulls. As will be appreciated, in most applications the settings will be predetermined, or will be "factory-set" for each emitter. It will be further appreciated that addition of a secondary transducer is possible on many of the other example embodiments set forth herein. The use of the secondary transducer with the other example embodiments is to the same purpose, and to achieve essentially the same effect accomplished in one of the ways just discussed. By way of one example of many that could be given, a secondary transducer can be added to the configuration of FIG. 13 (as shown in that figure) . This can be used to improve the rearward null for example as will be made more appreciable from the discussion below of FIG. 27.

With reference to FIG. 38, gradient schemes can also be used, as illustrated by the example of that figure. The gradient emitter 252 can comprise two emitters 49*a,b* such as discussed above in connection with FIG. 1 for example; and these are separated by a distance 254. As is known in the operation of gradient systems and as discussed above, the distance in one example can be one quarter wavelength, and the two emitters can be operated at a quarter wave phase difference so that the outputs are additive in the forward direction and cancel in a rearward direction. This gives rise to the sound pattern illustrated by the superimposed hypothetical cardioid sound pressure level plot 256 shown in the figure. The side and rear nulls are usually mutually exclusive as is known in such a system, but can be relatively adjusted by manipulation of relative level of the two emitters 49*a*, 49*b*.

With reference to FIG. 39 in a variant of the gradient emitter 252 just discussed, the side levels can be better nulled by providing only a "front wave" of limited power on the rear emitter 49*b*, thus enabling by delay additional nulling adjustment in the rearward direction, a small increase in the forward direction level and some adjustment capability overall. The transducer 258 of the rear emitter can be enclosed and the two emitters separately mounted, or in another example the emitters can be connected to form an inner chamber 260 and the rear transducer 258 can be mounted within that chamber.

With reference to FIG. 40, in another gradient example the two emitters 49 can be mounted separated from each other and facing the same way to form a gradient emitter 252. Again the level, or phase, or both, of one with respect to the other can be adjusted as needed to improve the cancellation to the rear or side or both as desired to correct for imbalances in level and phase. In one embodiment the rear emitter can be of much lower power and can act essentially as a vernier to optimize performance of the front emitter analogous to the auxiliary and primary emitter combinations discussed above.

Figure 29:
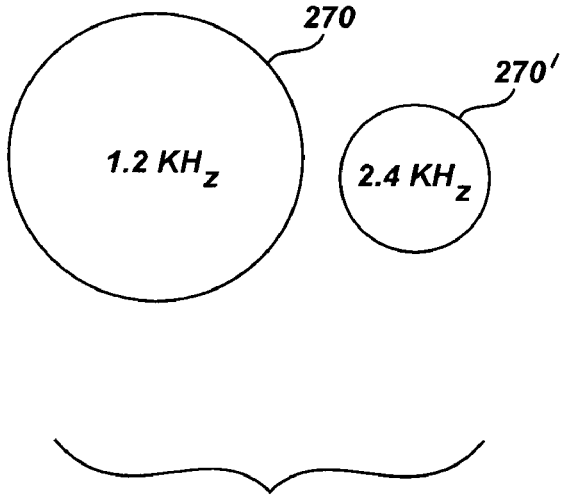
FIG. 29 is a schematical comparative front view of two example emitter profiles illustrating size relative to frequency of a design tone frequency.
Figure 31:
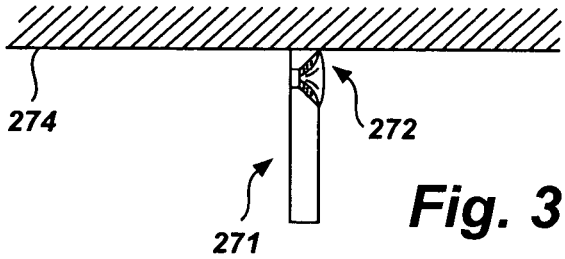
FIG. 31 is a schematical side cross section view of the example embodiment shown in FIG. 30.
Figure 30:
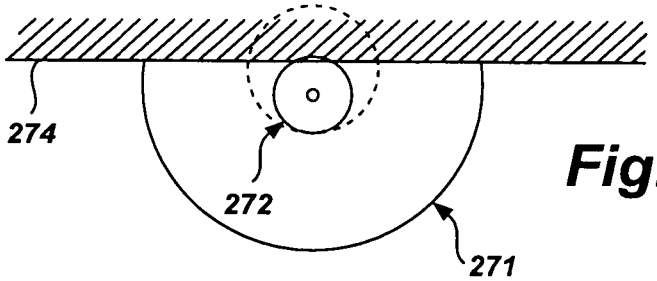
FIG. 30 is a schematical front view of an example emitter embodiment mounting configuration.

With reference to FIG. 29, as to all the embodiments, the size of the device 270, 270' overall is dependant on the frequency of the narrow band or single frequency to be emitted. For example, as to the embodiment shown in FIG. 27, viewed from the front or back, would resemble that shown in FIG. 29 and would decrease in diameter by one half by doubling the frequency, for example from 1.2 kilohertz to 2.4 kilohertz. While this may seem obvious, it is important to remember in applications where the profile of the device is a consideration. For example if the emitter 270 is to be mounted on a vehicle and in a slipstream (not shown) wind resistance can be decreased (for example) by selecting a higher frequency (or frequencies) for the tone or narrow band of frequencies to be used. Moreover, because the device in the examples is symmetrical about the acoustic axis, it can be configured and mounted so that only one half the device as discussed in each case is presented to the slipstream. For example, as illustrated in FIGS. 30 and 31 the emitter 271 can be mounted so that the transducer 272 is mounted in or just below a surface 274, for example a bottom of a truck trailer, to present less wind resistance.

With reference now to FIG. 27, in this example the emitter is configured for a frequency range of about 1.2 to 1.4 kilohertz. The diameter of the front plate 276 is one half the wavelength at the 1.2 kHz frequency. The front plate is spaced from the rear plate 278 by a distance 280 of about one tenth to one fifth the radius 282 of the front plate. The forwardly extending portion 284 of the rear plate is disposed at an angle 286 of 45 degrees. The distance 288 that the portion extends at that oblique angle can bring it a up even with the front plate, or beyond, and in one example is such as to bring it even therewith. The width 290 of the opening can be approximately equal to the distance 280 between the plates. The transducer 292 can be about four to six centimeters in diameter. Inwardly extending portions 294 as discussed above can be provided, and/or a phase-plug or the like 296, but such were not used in the example now discussed. This example emitter was tested and the results are shown in the polar plot and parameter listing shown in FIG. 41.

With reference to FIG. 28 a similar device but configured with the rear plate extending backward at angle of about 60 degrees a distance 288 of about 5 centimeters was also tested and the results are shown in FIG. 42. It is interesting to note that the embodiment of FIG. 27 appears to be unbalanced slightly in the rearward axial direction and be more directional forward while the embodiment of FIG. 28 appears to have a more ideal null rearward, but has a higher SPL in the sideways directions.

With reference to FIG. 43, in another example embodiment the emitter 300 is configured with two transducers 301, 302 operating in monopole mode; i.e. they are closed-back units radiating in one direction. The forward baffle plate 303 is one wavelength in diameter, the wavelength of a first tone. In the illustrated example the rear baffle plate 304 extends around the forward plate as before described, but other configurations described above can be used. This example allows the levels of the first and second transducers to be individually adjusted for better cancellation. Also, the two transducers can project distinct tones, for example a first tone frequency plus 15 Hz and a first tone minus 15 Hz, for a difference tone (beats) of 30 Hz. Another difference in frequency can be chosen. In one embodiment the back transducer can emit two tones, one tone being the first tone, and a second tone being one with a wavelength which when multiplied by about 0.765 gives the diameter of the emitter baffle plate. In this way the device can emit two tones simultaneously, each of which is directional. This allows a dual tone acoustic signal to be emitted directionally. With reference to FIG. 44, in another embodiment a forward transducer 305 is a dipole, and so works as before described in connection with FIGS. 4, 13, and the like. The second transducer 302, can be operated to increase or decrease the level of the back wave in the waveguide space 56 between the baffles 303, 304. This by operating it in phase or 180 degrees out of phase with the first transducer and adjusting its level. In another embodiment the second transducer 302 can produce a second tone, again to create beats if the frequency difference is small, or a dual tone effect if the tone is the inverse of 0.765 times the wavelength of the tone of the first transducer, which in turn is the frequency corresponding to the diameter of the forward baffle in wavelength. Turning to FIG. 45, in another example embodiment a separate waveguide 56 is provided by a third baffle 306 for the output from the rear transducer 302. Producing a second tone, also with directionality gives the advantage of making the source of the audio signal more locatable for the human listener, therefore enabling better perception of the direction to the emitter from the listener. This is useful in warning devices, annunciators, etc. where the recipient of the audio signal is to be made aware of something and its location. Also a dual tone capability enables a richer, more engaging audio signal to be produced, as will be recognized by one skilled in the art.

With reference now to FIG. 46, in one example embodiment the configuration is similar to that shown in FIG. 43 discussed above, but the "rear" transducer 307 is sent a signal delayed one quarter wave from that of the "front" transducer 301. This means the rear transducer 307' and waveguide 56' are virtually at the position shown in outline in the figure. With this configuration, the waves cancel "forward" producing a null zone 308 in "front" of the emitter. The sound does not cancel to the sides and "rearwardly" as it is out of phase by one quarter turn. Thus if the device is "flipped around" it functions to produce a level polar plot 309 shown in the overlaid hypothetical plot 309. Thus the device has the advantage of tuning by changing the level and frequency of one transducer with respect to the other to obtain a better null zone.

With reference to FIG. 47, in another example embodiment three closed monopole transducers 301, 302, 310 and three baffles 303, 304, 311 are used. This again enables a dual tone directional device. The diameter of the most forward baffle 311 is about 0.765 of the wavelength of the tone produced by the middle transducer 301, while the diameter of the middle baffle 303 is about 0.765 of the wavelength of the tone produced by the rearmost transducer 302 in this example. The forward transducer allows adjustment of a trim audio signal than can include one or both tones at levels as needed to improve rearward/sideward cancellation. It adds to forward level as well. Moreover, the phase of the signal from the forward transducer can be adjusted as well to improve rearward/sideward cancellation. In another embodiment a forth transducer 312 can be used for further trim; again separately adjustable for level and phase of one or both tones to improve rearward/sideward cancellation. As will be appreciated, the transducers can be of lower cost and power handling because there are more of them in this example. Many separately adjustable transducers gives more flexibility in customizing the tonal quality of the audio signals emitted, as well as improving directionality by better matching of canceling signals to signals to be suppressed.

In another example embodiment using the same physical configuration, two tones are produced by the middle transducer 301, one corresponding to a wavelength which multiplied by 0.765 gives the diameter of the forward most baffle 311, and the other which has a wavelength that equals the diameter of the forward most baffle. In this case the forward most transducer 310 can produce this same tone and be phased with the middle transducer second tone to provide directionality in a manner described above with respect to FIGS. 1-3, a central source surrounded by a circular line source, the radius being one half wave length, while the other tone produced by the middle transducer is directional by the method discussed above.

As will be appreciated, more than one of the methodologies for directionality can be applied in this example. Because separate transducers are used, both in-phase (with different path lengths) and pseudo-gradient (out of phase, but similar path lengths) means discussed above, or combinations thereof, can be used in canceling "forward" or "rearward" to create null zones where cancellation occurs to bring the level down there as discussed above.

With reference to FIG. 48*a* in another example embodiment a dipole transducer 314 in a baffle arrangement such as discussed above in connection with FIG. 4 for example, is combined with a forward baffle 315 of smaller size and a second dipole transducer 316. This gives a two tone capability, also with directionality. As will be appreciated the forward baffle plate 315 and forward transducer 316 can be moved outward and another baffle plate 317 added, as shown in FIG. 48*b*. This increases efficiency as the front wave does not need to divert as far to get around the forward baffle 315.

With reference to FIG. 49, in another example embodiment a forward closed monopole transducer 330 cooperates with a rear monopole transducer 331 and a front baffle 332 and rear baffle 333 to provide a directional emitter similar to that described in connection with FIG. 43. Except however that the center transducer is not mounted in the front baffle, but in front of it in a small forward baffle 334. The forward transducer can also produce a second tone, which has a wavelength that is 1/0.765 of the diameter of the small forward baffle. This is also directional due to the smaller circular source being close to a much larger baffle 332. The second tone is cancelled side and rearwardly, and projects forwardly.

With reference to FIG. 50, in another example, a gradient scheme such as discussed above in connection with FIG. 3 is given a two tone capability. A first dipole transducer 318 is positioned adjacent a first waveguide 56 defined by a forward baffle 319 and a second baffle 320. A second waveguide 321 for the rear wave is given a flared shape, and eliminates the quarter-wave pipe of the example shown in FIG. 3. This is defined by an outer bell-shaped baffle 322 and an inner corresponding baffle 323. A smaller forward baffle 324 and second dipole transducer 325 provide a directional second tone. The diameter of the larger forward baffle is 0.765 times the wavelength of the first tone produced by the first transducer. The diameter of the smaller forward baffle is equal to the second (higher frequency) tone. A similar arrangement but with different frequencies is shown in FIG. 51.

With reference to FIGS. 52 and 53, in another example embodiment a directional emitter 340 includes closed monopole transducers 341 mounted in baffle plates 342 which in turn supports a number of concentric sheets or layers of sound absorbent material 343. As will be appreciated, sound propagating in a forward direction 344 which does not encounter the sound absorbent material will be projected forward. Whereas sound propagating through the sound absorbent material will be attenuated. This quiets the sides and rear of the device 340, and the device is simple, though somewhat larger than can be made using other methods described above.

The sound absorbent material 343 is layered or disposed in sheets separated by air gaps or alternating layers of more and less dense material, because sound attenuation is increased by proving density boundaries the waves must cross. Thus layers of material, which can be of alternating different densities, or the same density but separated by air gaps, for example, in the illustrated embodiment, are used. The material can be a foamed polymeric material, spun glass, or another spun resin, the latter two having confining support into layers as shown, or another sound absorbent material. While this embodiment works to provide directionality by absorption rather than cancellation of wave energy, it too can be effective in providing directed audio signals.

With reference to all the drawing figures, heretofore, the discussion has been directed to essentially single tone, or two, or three tone devices (some of which can produce another tone from the difference between two tones, i.e. a difference tone, or at least beats. Nevertheless, with the examples disclosed it will be appreciated that not just a single tone, or a single group of different single tones, can be produced. There is some room to vary the frequency and still have directionality, at least within certain bands around the design frequencies. Device examples where two or more such bands around different tones are used in overlapping fashion to provide a wider band response will now be discussed.

With reference to FIGS. 54 and 55 In another example embodiment rather than one, two, or a few distinct tones, an emitter 350 can be made to have a capability of reproduction of sound over a band 351 of frequencies. The emitter, along with associated electronics 352, as will be apparent from the following, is configured so as to enable reproduction across a range of frequencies enabling a wider band output, while retaining some or all of the directionality of the narrow-band examples discussed above. In general terms, this is done by means of providing a plurality of emitter portions 353, 354, each having (in the illustrated embodiment a plurality of bands 355, 356 of frequencies where sound can be emitted with directionality by the emitter portions, respectively. A crossover can be conventionally provided electronically to direct the appropriate frequency portions of the acoustic signal to be reproduced to the appropriate portion(s) of the emitter. Equalization can be applied as well to smooth response and close gaps in bands as will be discussed in more detail below.

Specifically with reference to FIG. 54, in one example embodiment the emitter 350 is configured similarly to the examples shown in previous figures, with round disks forming baffles 360, 362, 364 and transducers 361, 363, 365. In this example the transducers are monopole types. A rear portion 353 of the emitter portions has a disk diameter 366 of about one foot in the example. The forward portion 354 has an associated disk diameter 367 of about eight and one half inches in the example. The baffle 362 intermediate the front and rear emitter portions serves both, as does the transducer 363 mounted therein. That is to say, this middle transducer 363 serves as a forward transducer for the rear portion and a back transducer for the forward portion. Audio signals for both portions are sent to the same transducer in this embodiment. Moreover, a low pass functionality can be provided in the larger diameter portion by providing higher frequency absorbing material 368 in one embodiment. The function of the low pass functionality will be described below.

Specifically with reference to FIG. 55, because of the different diameters of the portions 353, 354 of the emitter, and the crossover provided in the electronics 352 in this example, an overlapping of frequency bands gives the wider band 351 over which an acceptable response envelope 370, 370' (370 prime) exists. Equalization of the response curves 372, 374 can extend the bands, as shown in outline, and raise the envelope height in which the response will be essentially linearly correspondent with the incoming audio signal in the forward axis (369 in FIG. 54). This is shown by the larger area under the curve(s) which corresponds to the 370' envelope shown in the figure. The intersection point 371 is controlling the un-equalized essentially linear response envelope of the device. In the frequency range around the intersection point 371 at higher SPL levels partial cancellation occurs forward to an extent introducing distortion, and the crossover is not availing at this frequency as both curves are down at this point, which will be appreciated with reference to the un-equalized response curves 374, 372. Equalizing these curves using electronics (352 in FIG. 54) conventionally can close the gaps between response curves, as illustrated by the outline curve portions 372' and 374' and thereby expand the envelope 370 to that shown at 370'.

Other emitter configurations having plural tone capability discussed above could be adapted to wider band devices using this approach. The response curves will be different depending on configuration, but the general idea can be implemented across a plurality of emitter examples disclosed herein by changing the other parameters accordingly.

With reference now to FIG. 56, it should be remembered that equivalent systems 380, 382 can be constructed with dipole transducers (e.g. 383) or with two monopole speakers 384, 385 driven 180 degrees out of phase. The two-monopole approach allows independent adjustment of the level and phase of the "front wave" 386 and "back wave" 387 which can be useful in configuring and tuning the system 382. Moreover, real-world systems creatable rarely exactly conform to the ideal conceptions, and this independent adjustability can help obviate that difference by facilitating said separate adjustment of two independently creatable wave trains. As to each of the above-discussed embodiments in the various figures of this disclosure, it will be appreciated that by manipulation of the configurations of the emitter involved two monopoles can be substituted for a single dipole, for example as shown in FIG. 57.

With reference to FIG. 57 it will be appreciated that two substantially equivalent systems 388, 390 are presented. A first system 388 using a dipole transducer 391 has absorbent material 392 in a wave guide space 393 as needed to match the amplitude of the front and back wave from the dipole transducer in a rear direction 394 for improved cancellation. A second system 390 using two monopole transducers 395, 396 allows this same matching to be effected electronically; and has the further capability of relative phase adjustment.

Moreover, separate signal processing can allow distinct signals different in other ways to be sent to the front and back transducers 395, 396. This can facilitate two or more separate acoustic signals being reproduced by the same emitter at the same time. For example, a first signal can be a directionally produced narrow band signal as described above. A separate second narrow band signal can be omni-directionally produced by phase rotation of a part of the second signal sent to one of the transducers to counteract the directional nature of the emitter. The two signals are essentially overlaid and the result is essentially the same as if it could be produced by separate emitters placed in the same point in space at the same time. The possibilities of this overlay approach will be further appreciated with additional examples.

In another example a first signal can be directionally projected in a first direction 397, while a second signal is directionally projected in at least one other direction (e.g. in an opposite direction 398). In an implementation in a back-up beeper, a warning tone can be sent outward from the vehicle while a much quieter masking signal can be sent towards the operator for example (not shown). In this latter embodiment not only is the level of the alarm brought down for the operator, but a further enhancement in the comfort of the operator is possible by creating a more pleasant and less jarring tone by introduction of the masking tone of, say, additional harmonics, etc. In one example of this implementation the transducers 395, 396 are operated 180 degrees out of phase to produce the first signal, and are operated in-phase and at an integer multiple of the frequency of the first signal to produce the second signal. In other examples a third, a forth, and so on, additional signals can also be simultaneously sent to the emitter. Again, each such signal can have a distinct and different polar plot pattern of dispersion, as will be appreciated by those skilled in the art. In one embodiment, the first and second signals can be at the same frequency, and the second signal can be used to alter the shape of the polar plot of the first signal; for example widening or narrowing the zone where the first signal is sent strongly. Vice-versa the same can be done for widening or narrowing the null zone where the waves emitted sum to zero.

Some additional examples of configurations where two monopole transducers are used (instead of one dipole) will now be discussed. With reference to FIG. 58, in another embodiment similar to that of FIG. 8 discussed above, an emitter 400 having two transducers 401, 402 provides the same overall functionality as discussed above, but allows the adjustments and further functionality just discussed in connection with providing two monopoles instead of one dipole. For example, in one embodiment the first signal has the cartioid dispersion pattern shown in the hypothetical overlay curve 403, which is similar to that for the dipole version discussed above. The second signal is at the same frequency but phase-rotated and relatively adjusted front to back between the two transducers so that it has a second plot 404 shown. This second signal is out of phase with the first signal so that the two signals additively produce a third plot 405 which has a directionality different from that of the first signal (403). This can, in some circumstances, substantially decrease overall efficiency, but the trade-off for this loss can be a different and more desirable dispersion pattern. For example, in the example just discussed, the resulting pattern is more directional. Since higher directionality is conventionally harder to achieve than higher efficiency in this context, this trade-off may afford advantages. This is true even if increased cost of the system required to give the SPL needed to achieve the result is considered.

With reference to FIG. 59, another example embodiment in an emitter 410 (this time similar to those of FIGS. 34, 34*a* discussed above), is realized using two monopole transducers 411, 412. As will be appreciated path lengths 413, 414 from the transducers to a point 415 are equalized using a folded configuration within the emitter for the output of a rear one of the pair of transducers. Again, separate adjustment for tuning of the system is enabled, as well as super-imposition of separate signals for additional effects as just discussed is enabled. For example as shown the sideways emissions are out of phase by ¼ wavelength. A separate set of signals that are out of phase front to back so that they cancel in both directions, but which are but out of phase by one quarter wavelength can be configured to just cancel the sideways emissions of the first signal. The result is essentially the same as that illustrated by the example shown in FIG. 58, the two separate signals combine to form a new pattern different from that of either the first or second signals.

With reference to FIG. 60, an example embodiment emitter 420 similar to that of FIG. 3 is realized using two transducers 421, 422. The example can otherwise function as described above in connection with FIG. 3. Again, in this embodiment of FIG. 60 however, tuning and alteration of the dispersion pattern is enabled by allowing distinct signals two be sent to the two transducers. Note that this embodiment is also similar to that of FIGS. 50 and 51 discussed above, and a variation is shown in FIG. 61 (emitter 423) where a wave guide 426 for the "rear wave" output of a monopole transducer 425 is likewise smoothed in configuration. Additional variation is illustrated by FIG. 62, which employs a folded configuration for such a wave guide 427 of the emitter 428 shown. Another variation is shown in FIG. 63. This latter version of an emitter 430 eliminates the folded configuration, and indeed the connection between the two round wave guides 431, 432 and simply involves a different electronic delay between the transducers 433, 434. The quarter wave pipe (36 in FIG. 3) is eliminated. Other physical structure 435 holds the wave guides in fixed relationship to each other. Again, superimposition of one or more additional acoustic signals can alter the dispersion pattern as just mentioned with the other embodiments just discussed. It will be appreciated that the principles of these latter few examples can be generalized an applied to many if not all the examples disclosed herein.

With reference now to FIG. 64, a narrow band device 436 can be realized in a relatively small physical space by providing three monopole transducers 437, 438, 439 in three circular baffle plates 440, 441, 442 of a diameter 443 of convenient size. For example the diameter can be about one-half wavelength in one example. Here wavelength being a representative value from the narrow frequency band to be reproduced by the device. Taking a single frequency tone as an example, a front wave signal is sent to a first transducer 437, and a backwave (phase angle 180 degrees) signal is sent to the middle transducer 438. By adjustment of one or more of the frequency (holding the baffle diameter fixed, relative amplitude of the front and back wave signals, and relative phase angle of the front and backwave signals, a polar plot approaching that shown in FIG. 65 (plot 65A) can be achieved. A second set of acoustic signals is sent to The middle 438 and rear 439 transducers, likewise 180 degrees out of phase with each other (more or less), and adjusted as to amplitude and phase angle to achieve a polar plot as shown in FIG. 65 (plot 65*b*) which is a mirror image of the prior-mentioned polar plot but reduced in amplitude so that the back lobe 446 matches, essentially, the back lobe 447 produced by the other pair (437, 438) of transducers, but 180 degrees out of phase therewith so as to cancel it. The resulting overall output of the device 436 is illustrated by the third plot (65*c*) of FIG. 65. It will be appreciated that by overlapping two directional signals in the device an improvement in directionality is achieved in a device of overall smaller dimensions compared with those discussed above having baffles of approximately one wavelength diameter. This can be significant in applications where the overall size of the device is important, and smaller is better.

Other ways of implementing the overlapping concept are possible. With reference to FIG. 66, a dipole device 450 employing two dipole transducers 451, 452 in baffles 453, 454 separated by a middle baffle 455 is configured for directional projection of an audio signal of narrow band character. Here again the diameter 456 of the device is considerably smaller than those described above having a full wavelength diameter (approximately). By adjustment of the frequency of the output of the first transducer 451 a first output of non-ideal directional nature is obtained. This is shown in FIG. 67 (plot 67*a*). A second, mirror image (but down in amplitude) audio signal that is reverse in phase and direction is sent to the back transducer 452 and gives the plot shown in FIG. 67 (plot 67*b*). The resulting overall output is the sum of the two outputs, shown in FIG. 67 (plot 67*c*). As with the prior example, the undesirable parts of the directional acoustic outputs of two overlapping signal regimes cancel out when the signal regimes are coordinated with the device configuration.

Another example of this concept is realized in a gradient embodiment having an entirely different form factor. With reference to FIG. 68, a narrow band emitter 460 of elongated small diameter form includes a gradient scheme comprising two transducers 461, 462 separated by one quarter wavelength 463. The audio signal is fed to these transducers, and that to one transducer is delayed by 90 degrees phase shift, to give a first audio signal regime, illustrated by the output plot 69*a* shown in FIG. 69. The signals sent to these transducers to give the first signal regime are combined and rotated 180 degrees and simultaneously fed to the first transducer 461 and a third transducer 464 located one half wavelength from the first transducer. This second signal regime creates an audio output as shown in plot 69*b* of FIG. 69. The two signal regimes together create the more directional output shown in plot 69*c* of FIG. 69. As will be appreciated, a fourth transducer 465 could be added, and the second signal regime could be sent to that forth transducer and the third transducer 464. However, the example works with just three transducers.

A further reduction in size can be realized at the cost of additional complexity in signal processing is provided (as well as some additional complexity in handling the acoustic path lengths in air in the device as discussed above in connection with the example shown in FIG. 59). With reference to FIG. 70, in one example embodiment an emitter 470 similar to that discussed above and shown in FIG. 59 includes two transducers 471, 472 in a wave guide housing 473 configured to produce a gradient effect as discussed above. A further transducer 474 is included, and is positioned as shown. A delay is used to create a virtual position for the further transducer, shown as 474' at the virtual position. Looking front to back, and vice versa, the virtual position is one half wavelength from the first or front transducer 471 or the second or rear transducer 472. A cancellation scheme such as that shown in FIG. 69 is effected by introducing a delay into the signal paths to the front transducers 471, 472—this allows a phase shifted signal to be sent to the further transducer 474 in the rear. This phase shifted signal is paired with a signal sent to one of the other transducers to produce the canceling signal (69*b* plot in FIG. 69). As will be appreciated, the delay to the primary signal (69*a* in FIG. 69 sent to the front transducers mentioned above is so that a delay to create the virtual position 474' can be accommodated. Also, depending on which of the front transducers is used to form the canceling pair, the delays can be further adjusted as needed. For example, if the rear transducer 472 is used, the delays must be further adjusted so that the signals match as the pathway from the rear transducer 472 to the far field at 90 degrees (and 270 degrees) is longer by a quarter wavelength than that from the front transducer 471 to the same location(s). In any event it will be apparent that overlapping systems can be created in this way to produce a more directional output.

With reference to FIG. 71 it will be appreciated that a similar configuration, but for replacement of two monopole transducers with a single dipole transducer 478, can achieve a similar result in an emitter example 477 illustrated. Here the signal sent to a rear transducer 480 is likewise paired with one of the front wave or the back wave of the forward dipole, and is delayed and phase rotated to give an independent radiation pattern similar to that shown in plot 69*b* of FIG. 69. Again, the whole signal sent to the transducers is delayed so that the relative delays can be effected, as the signal (69*a* in FIG. 69) to the front transducer is "advanced" compared to portions of the cancellation signal, and time is needed to create the phase rotations and delays needed for the signals that implement the scheme. In other words the program material as a whole can be delayed, as some signal paths require more delay and some less and processing can introduce delays that need to be mitigated. Moreover, it will be appreciated that in the dipole example the cancellation signal is limited to one half the output of the dipole, so the cancellation to the sides will be less effective by half, and the resulting pattern will be something in between plot 69*a* and plot 69*c*.

With reference to FIG. 72 in another embodiment an emitter 482 is constructed so that a distance 484 of about a quarter wavelength is created across the "back" of the emitter. This causes a more narrow null zone in the "rear" direction, as shown by plot 73*a* in FIG. 73. A "cancellation" signal (plot 73*b* in FIG. 73) is sent to the rear transducer 486 which radiates omni directionally and is out of phase. As will be appreciated the overlapping of these audio signals results in a narrow beam in the "rear" direction (as defined in the previous examples) shown by plot 73*c* in FIG. 73. As will be appreciated, efficiency is traded for directionality in this example.

With reference now to FIGS. 74 and 75, an example of a wide-band directional emitter 490 includes a dipole transducer 492, or two monopoles 493, 492' disposed in a baffle and waveguide arrangement as discussed above. Two baffle plates 494, 495 are closely spaced to create a waveguide 496 for a "rear" wave as discussed above. The rear baffle 495 can fold around and provide forwardly extending portions 495*a* around the periphery as discussed above. The baffles in one example are circular and the transducers are off center in at least one of two axes of symmetry 496, 497 as shown in FIG. 76. The baffles in another example are elongated in one or more axes (e.g. 497 in FIG. 76). The transducer(s) can be in other locations 498, 499 in other examples. The salient principle is that the distance from the transducer(s) to the outer periphery of the waveguide varies. As will be appreciated there is then no one distance corresponding to a frequency which will cancel the forward wave as in the examples shown in FIGS. 54 and 55. Accordingly, wide band response is possible without the need for overlapping systems described above. Moreover, the response of the emitter can be adjusted to some extent by adjusting the path lengths; that is to say by providing a different shape of the emitter 490' waveguide, kind of equalization is possible, by emphasizing certain path lengths and minimizing others, relatively speaking. A further adjustment can be made by providing attenuating material 500 of variable density in the waveguide space 496. As shown in FIG. 77 the shorter distances can have more dense material in the pathways, while the longer distances have less dense material in the pathways. Since the devices are asymmetrical, in a stereo implementation the asymmetry can be mirror reflected to provide overall symmetry left to right across an axis of symmetry 501 as illustrated in FIG. 78.

As illustrated in FIGS. 79 and 80 in other examples various shapes can be combined with multiple transducers 509, 510, 511 at multiple locations. These transducers can be of various sizes and/or various types, and crossovers (not shown—conventional) provided to direct various frequency spectrum portions to various speakers positioned with respect to the baffle 494, 495 shape and edges to give the response desired.

As will be appreciated with reference to FIG. 81, in another example the entire face of a forward baffle 512 can be covered with transducers 513. Again, these can be dipoles as shown in FIG. 82, or monopole pairs 513' as shown in FIG. 83. Again the waveguide 515 is defined by baffles 514, 512 as previously described. The rear baffle can have forwardly inclined portions 515' as previously described. This configuration also provides a wide band directional emitter 520. Moreover, as will be appreciated, this configuration can be beam-steered by providing delays in the signal pathways to individual rows and columns of transducers. This also allows the sound emitted to be focused, by providing delays from the outer rows and columns to the innermost rows and columns (or a single central transducer—not shown) or vice versa. With reference to FIG. 84, in another embodiment the face of the emitter 522 can be likewise covered by transducers 513, but these can be randomly placed, and/or can be of various sizes/types. Again, in one example a crossover network can be provided to direct different frequency spectrum portions to different transducers.

With the examples shown in FIGS. 81 and 82 it will be appreciated that the audio signal pathways in air are equal to the side and rearward for each dipole or monopole pair 513, 513', and that the distance to the edges of the baffles 512, 514 is different for each transducer (but symmetry can result in several sets of transducers each having the same sets of uneven distances to the edges). Therefore the forward wave cancellation effects are again masked by redundancy, and a wideband response is enabled.

With reference to FIG. 85 in another embodiment the numerous conventional transducers are replaced by a planar magnetic transducer (PMT) 532 in an emitter 530 otherwise configured as before described. As illustrated by FIG. 86 in another example several rows 533, 534, 535 of PMT transducers can be used. As with the previously described embodiments monopole and dipole transducers can be used. With reference to FIG. 87 dipole PMTs 533, 534, 535 are mounted in a front baffle 536. In FIG. 88 another example is shown incorporating dipole pairs of PMTs 533',534', 535' mounted in the front baffle and rear baffle 537 (which, again, can have forwardly extending portions 537' at the edges).

With reference to FIG. 89 in another example an electrostatic transducer 542 covers most of the front of an emitter 540 otherwise configured as before described. Again, as shown in FIGS. 90 and 91 monopole and dipole devices can be used. The emitter otherwise can be as before described.

With reference to FIG. 92, in another example the face of an emitter 550 using PMT or electrostatic type transducers is divided into transducer columns 551, 552, 553, etc. and can be divided into rows 557, 558, 559, etc. as well if multiple transducers are provided in each column. Using dipole devices as an example, as illustrated in FIG. 93 the front baffle 560 carrying the transducers (or defined by them) is backed by a rear baffle 562 as before described. Delays can be used to focus and/or beam steer the output, for example moving and shaping the front baffle's effective position (and also the rear baffle). In one example the delay is between the inner and outer columns and the virtual position of the emitter elements is shown designated by primed reference numbers 560', 562' to give a focusing result.

Other examples of wide band devices using plane form transducers (PMTs will be shown and described as examples only) can include embodiments where less than all the front baffle is covered. For example with reference to FIGS. 94, 95, a dipole PMT transducer 572 is mounted in a circular emitter 570 of two baffle plates 573, 574 as before described. These baffle plates can be other shapes e.g. 575, 576 as will be appreciated. Again distances from the transducer to the edges of the baffles vary, so the front wave cancellation is smoothed and wide band response results. Other shapes are illustrated by FIGS. 96, 97 and 98, with variations.

A further variation is illustrated by FIG. 99, wherein an emitter 590 various transducers, 591, 592, 593, 594, 595, are arranged to have various non-canceling ranges of distances to the baffle 596 edges corresponding to various frequencies. These can be connected via a crossover network (not shown—conventional) to a signal source (not shown) so that the portions of the signal to be optimally reproduced directionally are sent to the corresponding transducer for that frequency range from among the set of transducers of the device.

With reference to FIGS. 100, 101 and 102, an example embodiment in a device 600 which facilitates much more intense outputs, employs a number of transducers 602 arranged in a hemispherical support 604. These transducers can be of one of a number of types, for example conventional loudspeakers using magnetic voice coil motor technologies, piezo-electric types, or other types. In order to increase output, increasing the power density of acoustic motors in the hemisphere is desirable. Accordingly, transducer types which give high power output in small physical sizes are desirable. In one embodiment, instead of a hemisphere, a cylindrical section can be used, for example having the a cross-section such as that shown in FIG. 100. In such an example, elongated transducers such as ribbons, elongated planar magnetic transducers, and the like, can be used. In other words, the transducers 602 shown schematically can be a wide variety of types.

With reference to FIGS. 100-102, it will be appreciated that the transducers are divided into at least two groups 606, 608 divided from each other by at least one wave guide 610, in the illustrated example being configured as a frustum of a cone and opening into a central opening 612 comprising an outlet for the output of one group (606) of transducers. It will be appreciated that this takes the place of the central transducer discussed in the previous examples. The frustoconical wave guide and a front baffle plate 614 direct the output from the second group of transducers (608) to a concentric opening 616 just outside the central opening. The two groups of transducers are phase-flipped so as to be 180 degrees out of phase with respect to each other. They can be independently adjusted in SPL for matching for improved cancellation as in the embodiments discussed previously. A front baffle plate 618 wave guide is provided to separate two wave trains from the two respective groups of transducers which exit the concentric openings 612, 616 about one hundred eighty degrees out of phase, as discussed with reference to the previously presented examples. The forward baffle wave guide can be elliptical, or other shape to prevent forward cancellation at certain frequencies, as discussed above, or for a narrow band device can be round as shown alternatively (618 alt.).

As will be appreciated it is the openings 612, 616, and the forward baffle wave guide 618 which give rise to directionality in the ways discussed above. In this example the hemisphere 604 containing the transducers 602 can be of essentially any convenient practicable size for the number and type of transducers used, as directional functionality does not depend on the size of the hemisphere. In one embodiment the size of the hemisphere is chosen to create a Heimholtz resonance in at least one of at least two chambers 620, 622 into which the two groups of transducers 606, 608 (respectively) direct their output. This can be done to increase the output from at least one group of transducers. Moreover, as will be appreciated the wave guides 610, 618, and openings, 612, 616, can be modified, smooth transitions supplied, and shaping provided, to maximize output and minimize sonic artifacts arising from geometry, edges, and transitions, as is well known in the art.

Using efficient, small, transducers 602 a relatively large SPL output can be directionally created using a device 600 such as illustrated in the example which is not unduly large. As will be appreciated across a narrow frequency band, coinciding with a resonant frequency of the transducers and coordinated with the structure to be directional along an acoustic axis 624, a very high SPL output signal can be directionally generated. Likewise, across a wider band voice or other acoustic signal can be directionally generated, at less intensity than a narrow band signal, but still with very high power.

With reference to all the drawing figures, it will be appreciated that directionality in emitted sound of a single frequency or narrow band of frequencies can be obtained using low cost means which can be both simple and robust (to survive in various service environments). While specific examples have been disclosed, it will be appreciated that modifications and variations can be made without exercise of inventive facility, and the scope of the invention is not intended to be limited to the disclosed examples.

What is claimed is:

1. A directional acoustic emitter having an acoustic axis, including:

at least one transducer configured to impart at least two acoustic wave trains into a fluid media along at least two pathways;

at least one wave guide, configured for separating the wave trains along at least a portion of their pathways;

the wave guide configured so that over at least one narrow frequency range the wave trains do not destructively interfere along the acoustic axis in a positive direction so as to eliminate useful output, and which do destructively interfere along the acoustic axis in a negative direction, and which at least partially destructively interfere in a direction transverse to the acoustic axis.

2. The emitter of claim 1, wherein the narrow frequency range is restricted to substantially a single frequency.

3. The emitter of claim 2, wherein the single frequency is between about 1.2 kilohertz to about 1.4 kilohertz.

4. The emitter of claim 2, wherein the waveguide includes an emitter face having a diameter of about one wavelength of the single frequency.

5. The emitter of claim 2, wherein the waveguide includes a substantially circular emitter face.

6. The emitter of claim 5, wherein the pathways radiate outwardly from a single, central transducer through at least one circularly expanding waveguide.

7. The emitter of claim 5, wherein the waveguide includes a diameter of between about 0.6 and about 0.8 times the wavelength of the frequency.

8. The emitter of claim 7, wherein the waveguide includes a diameter of about 0.765 times the wavelength of the frequency.

9. The emitter of claim 1, wherein the waveguide includes an emitter face that is symmetrical about the acoustic axis.

10. The emitter of claim 1, wherein a single transducer imparts the at least two wave trains.

11. The emitter of claim 1, further comprising at least two transducers, each imparting one of the at least two acoustic wave trains into the fluid media.

12. The emitter of claim 11, wherein the output of one of the transducers is electrically reduced to enhance destructive interference in the negative or transverse directions.

13. The emitter of claim 11, wherein the output of one of the transducers is electrically phase shifted to enhance destructive interference in the negative or transverse directions.

14. The emitter of claim 11, wherein the output of one of the transducers is electrically phase shifted to reinforce output in the positive direction.

15. The emitter of claim 2, where the two pathways impart at least two acoustical wavetrains into the media at locations separated by about ½ a wavelength of the single frequency.

16. The emitter of claim 2, wherein the narrow frequency range is substantially one dominant frequency.

17. The emitter of claim 2, further comprising a plurality of transducers combined to achieve a wideband system.

18. The emitter of claim 17, wherein each of the plurality of transducers operates at a different, substantially single frequency.

19. The emitter of claim 17, wherein at least one of the plurality of transducers produces a dominant frequency that is spaced one octave above a frequency of another of the plurality of transducers.

20. The emitter of claim 17, wherein at least one of the plurality of transducers produces a dominant frequency of about 2 kHz, and wherein another of the plurality of transducers produces a dominant frequency of about 1 kHz.

21. The emitter of claim 17, wherein at least one of the plurality of transducers produces a dominant frequency and one or more odd multiples thereof.

22. The emitter of claim 17, wherein at least one of the plurality of transducers produces a dominant null frequency at even multiples of a dominant frequency.

23. The emitter of claim 21, wherein the at least one of the plurality of transducers produces a dominant frequency at about 1 kHz, about 3 kHz and about 5 kHz.

24. The emitter of claim 1, wherein the output of at least one of the pathways is acoustically reduced with acoustically absorbent material to further enhance destructive interference.

25. A directional acoustic emitter having an acoustic axis, including:

at least one transducer configured to impart at least two acoustic wave trains having a common frequency into a fluid media; and at least a pair of wave guides, defining a first pathway and a second pathway, the second pathway having a length that differs from a length of the first pathway by about ½ wavelength of the common frequency such that: over a selected frequency range, the wave trains do not destructively interfere along the acoustic axis in a positive direction so as to eliminate useful output, and which do destructively interfere along the acoustic axis in a negative direction, and which at least partially destructively interfere in a direction transverse to the acoustic axis.

26. The emitter of claim 25, wherein the first and second wave guides include substantially cylindrical pipes.

27. The emitter of claim 26, wherein the first and second wave guides are concentric pipes.

28. The emitter of claim 27, wherein at least one of the waveguides is folded, such that a greatest overall dimension of the directional acoustic emitter is less than a sum of the lengths of the first and second pathways.

29. The emitter of claim 25, wherein one of the waveguides is about a ¼ wavelength pipe and wherein another of the waveguides is a folded pipe of about ½ wavelength.

30. The emitter of claim 25, wherein a single transducer imparts the at least two wave trains.

31. The emitter of claim 25, further comprising at least two transducers, each imparting one of the at least two acoustic wave trains into the fluid media.

32. A craft operable to directionally emit an acoustic warning signal, comprising:

a vehicle; and an emitter, coupled to the vehicle, the emitter including:

at least one transducer configured to impart at least one acoustic wave train into a fluid media along at least two pathways;

at least one wave guide, configured for separating the wave trains along at least a portion of their pathways;

the wave guide configured so that over a narrow frequency range the wave trains do not destructively interfere along an acoustic axis of the emitter in a positive direction so as to eliminate useful output, and which do destructively interfere along the acoustic axis in a negative direction, and which at least partially destructively interfere in a direction transverse to the acoustic axis.

33. The craft of claim 32, wherein at least two acoustic wave trains are imparted into the fluid media.

34. The craft of claim 32, wherein the emitter is aligned relative to the craft such that the acoustic axis of the emitter is aligned with a direction of travel of the craft.

35. The craft of claim 34, wherein the emitter is aligned relative to the craft such that the positive direction of the emitter is oriented toward a reverse direction of travel of the vehicle.

36. The craft of claim 32, wherein the narrow frequency range is restricted to substantially a single frequency.

37. The craft of claim 36, wherein the two acoustic wave trains are imparted into the fluid media from locations separated by about ½ a wavelength of the single frequency.

38. The craft of claim 33, wherein a single transducer imparts the at least two wave trains into the fluid media.

39. The craft of claim 33, further comprising at least two transducers, each imparting one of the at least two acoustic wave trains into the fluid media.

40. The craft of claim 32, wherein the pathways radiate outwardly from a single, central transducer through at least one circularly expanding waveguide.

41. The craft of claim 40, wherein the single, central transducer imparts a single acoustic wave train that is directed into the at least two pathways.

42. A directional acoustic device configured for directing an acoustic output along an acoustic axis, including:

at least one transducer configured for creating at least two wave trains which can be made to have a differing phase with respect to each other and which follow wave paths different in length;

at least one wave guide which is configured to define at least a part of the paths and to create a difference in length of the paths;

the wave trains destructively interfering in directions more than ninety degrees off the acoustic axis and reinforcing each other in directions less than ninety degrees off the acoustic axis.

43. The device of claim 42, further comprising at least two transducers, each creating one of the wave trains.

44. The device of claim 43, wherein one of the wave paths is a folded wave path and has a greater length than another of the wave paths.

45. The device of claim 43, wherein at least one of the wave paths comprises a substantially cylindrical wave pipe.

46. The device of claim 45, wherein at least one of the wave pipes comprises a quarter-wave pipe.

* * * * *